US009080547B2

(12) United States Patent
Shiraishi et al.

(10) Patent No.: US 9,080,547 B2
(45) Date of Patent: Jul. 14, 2015

(54) ENGINE CONTROL APPARATUS AND METHOD

(75) Inventors: Taisuke Shiraishi, Yokohama (JP); Eiji Takahashi, Yokosuka (JP); Tomonori Urushihara, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 238 days.

(21) Appl. No.: 12/269,959

(22) Filed: Nov. 13, 2008

(65) Prior Publication Data

US 2009/0126684 A1 May 21, 2009

(30) Foreign Application Priority Data

Nov. 16, 2007 (JP) ..... 2007-298409

(51) Int. Cl.

| | |
|---|---|
| ***F02P 3/01*** | (2006.01) |
| ***F02P 23/04*** | (2006.01) |
| ***F02D 41/30*** | (2006.01) |
| *F02M 27/04* | (2006.01) |
| *F02P 9/00* | (2006.01) |

(52) U.S. Cl.

CPC ..... *F02P 23/04* (2013.01); *F02D 41/3041* (2013.01); *F02M 27/042* (2013.01); *F02P 3/01* (2013.01); *F02P 9/007* (2013.01)

(58) Field of Classification Search

CPC ..... F02M 27/042; F02P 9/007; F02P 23/04; F02P 3/01

USPC .... 123/143 A, 143 B, 145 A, 169 E, 169 EL, 123/169 MG, 606, 608, 636, 637, 637 L, 536

See application file for complete search history.

(56) References Cited

U.S. PATENT DOCUMENTS 4,091,779 A * 5/1978 Saufferer et al. ..... 123/536
5,469,013 A * 11/1995 Kang ..... 313/138

(Continued)

FOREIGN PATENT DOCUMENTS

| | | |
|---|---|---|
| EP | 2020503 | 2/2009 |
| GB | 2352772 | 2/2001 |
| JP | 2001-020842 A | 1/2001 |

OTHER PUBLICATIONS

The extended European Search Report for the corresponding European Patent Application No. 08168930.9-1263 dated Sep. 20, 2012.

*Primary Examiner* — Mahmoud Gimie
*Assistant Examiner* — David Hamaoui
(74) *Attorney, Agent, or Firm* — Global IP Counselors, LLP

(57) ABSTRACT

An engine control apparatus has an electric discharge device, a voltage application device, a fuel supplying device, and a control unit. The electric discharge device includes a first electrode and a second electrode. The second electrode is arranged opposite the first electrode to produce radicals within a combustion chamber of an internal combustion engine by a non-equilibrium plasma discharge that is generated between the electrodes before autoignition of the air-fuel mixture occurs. The voltage application device is operatively coupled to the first electrode for applying a voltage between the first and second electrodes to generate the non-equilibrium plasma between the first and second electrodes. The fuel supplying device forms an air-fuel mixture inside the combustion chamber. The control unit is operatively coupled to the electric discharge device to set a discharge start timing of the electric discharge device to occur during an intake stroke of the internal combustion engine.

8 Claims, 26 Drawing Sheets

(56) References Cited

U.S. PATENT DOCUMENTS

| | | | | |
|---|---|---|---|---|
| 6,267,097 | B1 * | 7/2001 | Urushihara et al. | 123/305 |
| 6,293,246 | B1 * | 9/2001 | Tanahashi et al. | 123/305 |
| 6,467,467 | B1 * | 10/2002 | Massholder | 123/536 |
| 6,761,147 | B2 * | 7/2004 | Majima | 123/399 |
| 7,392,795 | B2 * | 7/2008 | Nagamine et al. | 123/536 |
| 7,625,531 | B1 * | 12/2009 | Coates et al. | 422/186.04 |
| 7,644,698 | B2 * | 1/2010 | Shiraishi et al. | 123/406.19 |
| 2007/0266979 | A1 * | 11/2007 | Nagamine et al. | 123/143 B |
| 2009/0031984 | A1 * | 2/2009 | Shiraishi et al. | 123/260 |
| 2009/0031988 | A1 * | 2/2009 | Shiraishi et al. | 123/406.19 |
| 2009/0114178 | A1 * | 5/2009 | Coates et al. | 123/143 B |
| 2009/0165436 | A1 * | 7/2009 | Herbon et al. | 60/39.826 |
| 2009/0229581 | A1 * | 9/2009 | Ikeda | 123/536 |
| 2010/0212620 | A1 * | 8/2010 | Shimizu | 123/143 B |

* cited by examiner

NO DISCHARGE

DISCHARGE IS INITIATED DURING COMPRESSION STROKE (IN THE VICINITY OF 180-0 deg BTCD)

DISCHARGE IS INITIATED DURING INTAKE STROKE (IN THE VICINITY OF 180-360 deg BTCD)

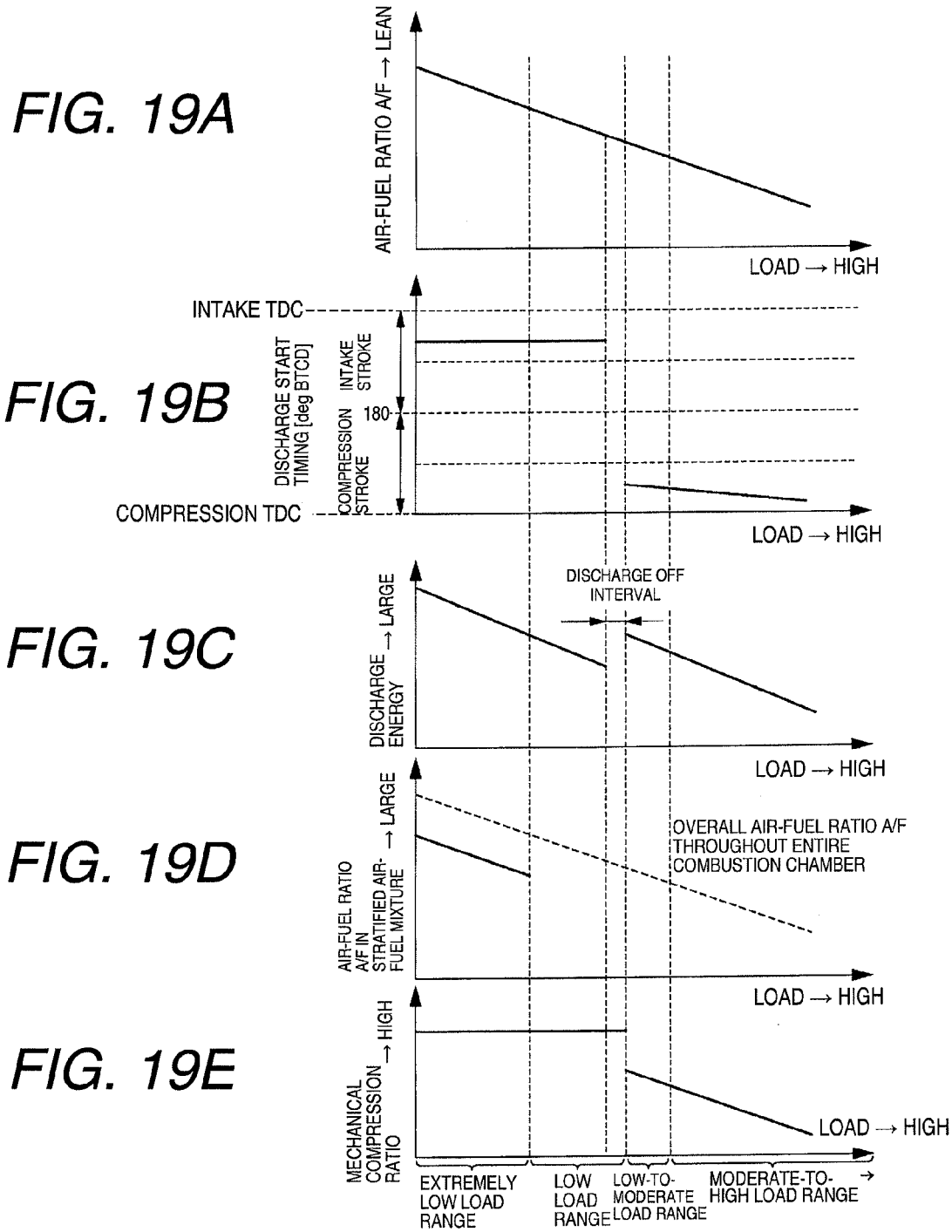
FIG. 19A
AIR-FUEL RATIO A/F → LEAN
LOAD → HIGH
FIG. 19B
INTAKE TDC
DISCHARGE START TIMING [deg BTCD]
INTAKE STROKE
180
COMPRESSION STROKE
COMPRESSION TDC
LOAD → HIGH
FIG. 19C
DISCHARGE OFF INTERVAL
DISCHARGE ENERGY → LARGE
LOAD → HIGH
FIG. 19D
AIR-FUEL RATIO A/F IN STRATIFIED AIR-FUEL MIXTURE → LARGE
OVERALL AIR-FUEL RATIO A/F THROUGHOUT ENTIRE COMBUSTION CHAMBER
LOAD → HIGH
FIG. 19E
MECHANICAL COMPRESSION RATIO → HIGH
LOAD → HIGH
EXTREMELY LOW LOAD RANGE
LOW LOAD RANGE
LOW-TO-MODERATE LOAD RANGE
MODERATE-TO-HIGH LOAD RANGE

ENGINE CONTROL APPARATUS AND METHOD

CROSS-REFERENCE TO RELATED APPLICATIONS

This application claims priority to Japanese Patent Application No. 2007-298409, filed on Nov. 16, 2007. The entire disclosure of Japanese Patent Application No. 2007-298409 is hereby incorporated herein by reference.

BACKGROUND OF THE INVENTION

1. Field of the Invention

The present invention generally relates to a control apparatus and a control method for an internal combustion engine. More specifically, the present invention relates to an engine control apparatus comprising an electric discharge device.

2. Background Information

An electric discharge device has been proposed for an internal combustion engine in which the air-fuel mixture is ignited in an assisted manner by a sparkplug. In this electric discharge device radicals are generated in a cylinder and the autoignition properties of the air-fuel mixture are improved (see, Japanese Laid-Open Patent Application No. 2001-20842). The radicals tend to induce oxidation reactions (i.e., combustion), and the oxidation reactions (combustion) tend to become chain reactions. Therefore, when radicals are generated in the cylinder, the autoignition properties of the air-fuel mixture are improved.

In view of the above, it will be apparent to those skilled in the art from this disclosure that there exists a need for an improved electric discharge device that produces radicals in an engine cylinder. This invention addresses this need in the art as well as other needs, which will become apparent to those skilled in the art from this disclosure.

SUMMARY OF THE INVENTION

As mentioned above, it has been discovered that, in order to improve the autoignition properties of the air-fuel mixture, a sparkplug can be used to generate radicals in the cylinder. However, since spark ignition is a thermal plasma discharge, the efficiency of radical generation is low even if spark ignition is induced by a sparkplug as in the conventional apparatus previously described. Moreover, in this conventional apparatus the amount of radicals generated is limited. It is therefore believed that the effects of improving the autoignition properties are small.

The present invention was designed in view of such conventional problems. One object of the present invention is to provide a control apparatus and a control method for an internal combustion engine that enables the autoignition properties of the air-fuel mixture to be improved in comparison with conventional internal combustion engines.

In accordance with a first aspect, an engine control apparatus is provided which basically comprises an electric discharge device, a voltage application device, a fuel supplying device, and a control unit. The electric discharge device includes a first electrode and a second electrode. The second electrode is arranged opposite the first electrode to produce radicals within a combustion chamber of an internal combustion engine by a non-equilibrium plasma discharge that is generated between the electrodes before autoignition of the air-fuel mixture occurs. The voltage application device is operatively coupled to the first electrode for applying a voltage between the first and second electrodes to generate the non-equilibrium plasma between the first and second electrodes. The fuel supplying device forms an air-fuel mixture inside the combustion chamber. The control unit is operatively coupled to the electric discharge device to set a discharge start timing of the electric discharge device to occur during an intake stroke of the internal combustion engine.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure:

FIG. 19A is a graph showing the relationship of an air-fuel ratio to various operational states of the engine having the electric discharge device in accordance with the second embodiment;

FIG. 19B is a graph showing the relationship of a discharge start timing to various operational states of the engine having the electric discharge device in accordance with the second embodiment;

FIG. 19C is a graph showing the relationship of discharge energy to various operational states of the engine having an electric discharge device in accordance with the second embodiment;

FIG. 19D is a graph showing the relationship of an air-fuel ratio in a stratified air-fuel mixture to various operational states of the engine having an electric discharge device in accordance with the second embodiment;

FIG. 19E is a graph showing the relationship of a mechanical compression ratio to various operational states of the engine having an electric discharge device in accordance with the second embodiment;

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First, the essential technological ideas relating to the internal combustion engine electric discharge device will be described.

As described above, an engine has been proposed in which spark ignition generates radicals (chemically active species which are in a state of molecular dissociation induced by the collision of high-energy electrons with fuel or air molecules, and which promote ignition of an air-fuel mixture) in a cylinder and in which the autoignition properties (compression ignition properties) of the air-fuel mixture are improved.

However, the effects of improving ignition properties in such an engine have been small. Specifically, spark ignition involves a thermal plasma discharge. In a thermal plasma discharge, kinetic energy is adequately exchanged among electrons, ions, and molecules. The result is an establishment of a state of thermal equilibrium in which the electron energy, the ion energy, and the neutral particle energy are in equilibrium with each other. Radicals are chemically active species which are in a state of molecular dissociation induced by collisions of high-energy electrons with fuel or air molecules, and which promote ignition of the air-fuel mixture. In spark ignition, energy is also imparted to ions and molecules which do not contribute to the generation of radicals, and the efficiency of conversion of input energy to electron energy is low. When the input energy is increased in order to increase the amount of radicals, there is a possibility that the electrodes will melt. Therefore, it is difficult to increase the amount of radicals.

In view of this, a non-equilibrium plasma discharge is preferred. In a non-equilibrium plasma discharge, a thermally non-equilibrium state is achieved in which the electron temperature (electron energy) alone is extremely high (more specifically, the electron energy is much higher than both the ion energy and the neutral particle energy, which is substantially equal to the ion energy), and the efficiency of converting input energy to electron energy is high. Heat loss is small in a non-equilibrium plasma discharge because the gas temperature is not increased. The danger that the electrodes will melt is also small.

Because of such reasons, radicals can be generated comparatively easily if a non-equilibrium plasma discharge is used. In view of this, an engine control apparatus having an electric discharge device is proposed herein.

Figure 1:
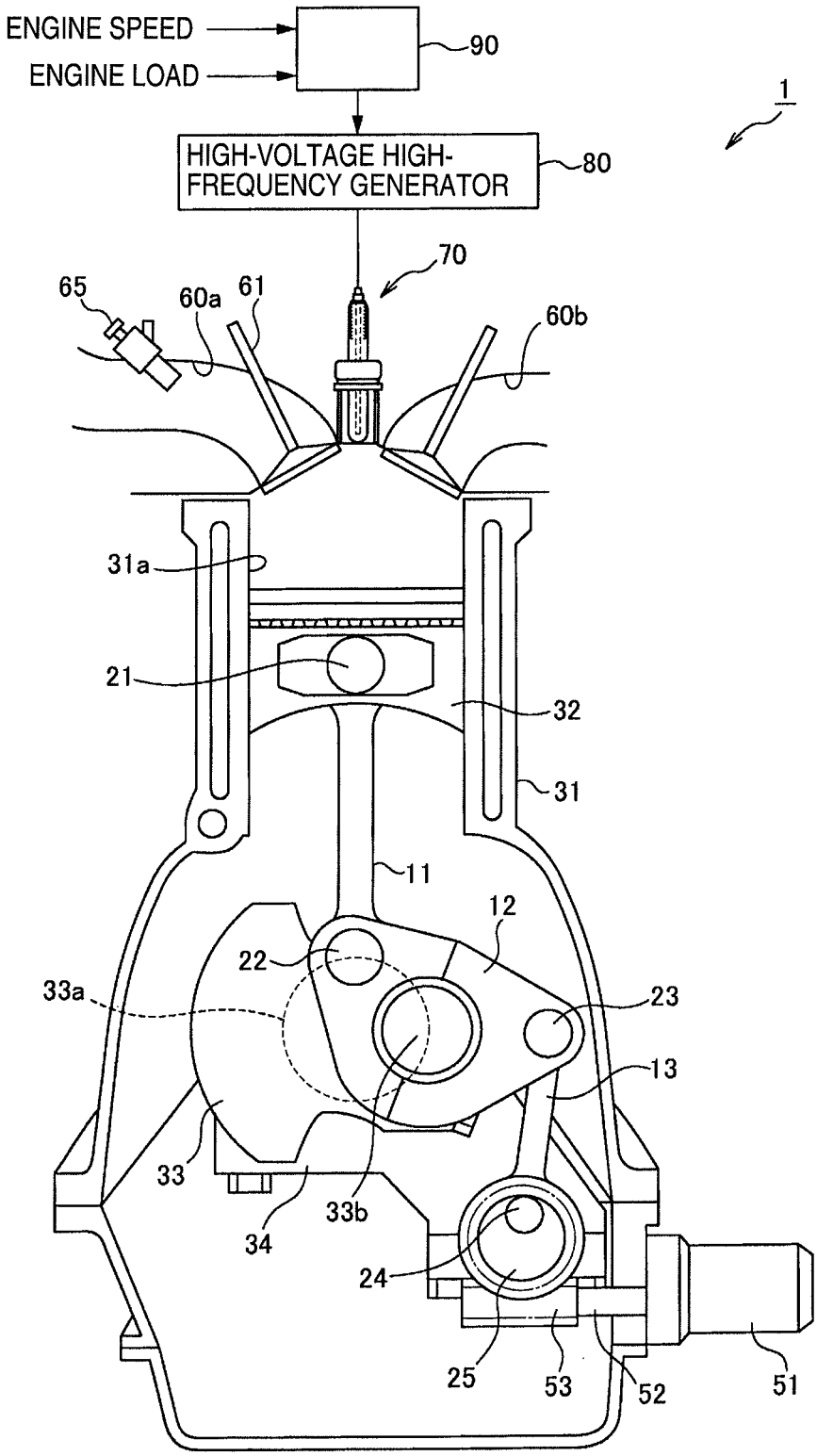
FIG. 1 is a simplified schematic cross-sectional view of a portion of a multi-link engine that contains an electric discharge device in accordance with a first embodiment.

Now referring to FIG. 1, a simplified schematic cross-sectional view of a portion of a multi-link engine 1 is illustrated that contains an electric discharge device in accordance with a first embodiment. As explained hereinafter, the multi-link engine 1 utilizes a non-equilibrium plasma discharge function to improve the autoignition properties of the multi-link engine 1.

The engine 1 is provided with a non-equilibrium plasma discharge device 70. The non-equilibrium plasma discharge device 70 is provided between an intake port 60*a* and an exhaust port 60*b*, substantially in the center of a combustion chamber of a cylinder head. The non-equilibrium plasma discharge device 70 generates radicals by means of a non-equilibrium plasma discharge. The non-equilibrium plasma discharge device 70 is also capable of igniting an air-fuel mixture through non-equilibrium plasma discharge when the engine is operating at a comparatively high load (when the air-to-fuel ratio of the air-fuel mixture is comparatively rich). The detailed structure of the non-equilibrium plasma discharge device 70 will be described hereinafter with reference to an enlarged view (FIG. 2).

The engine 1 having a barrier discharge function according to the present embodiment has a variable compression ratio mechanism (hereinafter referred to as a "multi-link variable compression ratio mechanism"), which uses a multi-link mechanism for connecting a piston 32 to a crankshaft 33 by two links. The multi-link variable compression ratio mechanism connects the piston 32 to the crankshaft 33 by an upper (first) link 11 and a lower (second) link 12. The multi-link variable compression ratio mechanism also controls the lower link 12 by using a control (third) link 13 to vary the mechanical compression ratio.

The upper link 11 is connected at the top end to the piston 32 via a piston pin 21. The upper link 11 is connected at the bottom end to one end of the lower link 12 via a connecting pin 22. The piston 32 receives combustion pressure that moves the piston 32 within a cylinder 31*a* of a cylinder block 31 back and forth.

The lower link 12 is connected at one end to the upper link 11 via the connecting pin 22. The lower link 12 is connected at the other end to the control link 13 via a connecting pin 23. The lower link 12 also has a substantially central connecting hole in which crank pins 33*b* of the crankshaft 33 are disposed. Thus, the lower link 12 oscillates around the crank pins 33*b* as a center axis. The lower link 12 is divided into two left and right members. The crankshaft 33 comprises a plurality of crank journals 33*a* and a plurality of crank pins 33*b* for each cylinder. The journals 33*a* are rotatably supported by the cylinder block 31 and a ladder frame 34. The crank pins 33*b* are eccentric relative to the crank journals 33*a* by a predetermined amount, and the lower link 12 is oscillatably connected thereto.

The control link 13 is connected to the lower link 12 via the connecting pin 23. The control link 13 is also connected at the other end to a control shaft 25 via a connecting pin 24. The control link 13 oscillates or rocks around the connecting pin 24. A gear is formed on the control shaft 25, and this gear meshes with a pinion 53 provided to a rotating axle 52 of an actuator 51. The control shaft 25 is rotated by the actuator 51 to move the connecting pin 24.

Various sensors are provided for sensing the operating state of the engine, including the engine rotation speed and the engine load. The signals of various sensors are inputted to a controller 90. The controller 90 controls the actuator 51 to rotate the control shaft 25 and vary the compression ratio. The controller 90 also controls a high-voltage high-frequency generator 80 so that an AC voltage value, an application duration, an AC frequency, an application timing, and other parameters corresponding to the operating state of the engine are applied to the non-equilibrium plasma discharge device 70. Thus, the controller 90 may be considered to constitute a non-equilibrium plasma discharge control unit. In addition, the high-voltage high-frequency generator 80 constitutes a voltage application device. Furthermore, the controller 90 controls the fuel injection of a fuel injection valve 65 provided to the intake port 60*a*. An intake valve 61 is capable of varying the opening and closing periods thereof, as is described hereinafter. The controller 90 determines the engine load and performs control according to the load. The controller 90 is configured from a microcomputer comprising a central processing unit (CPU), a read-only memory (ROM), a random access memory (RAM), and an input/output interface (I/O interface). The controller 90 can also be configured from a plurality of microcomputers.

Figure 2A:
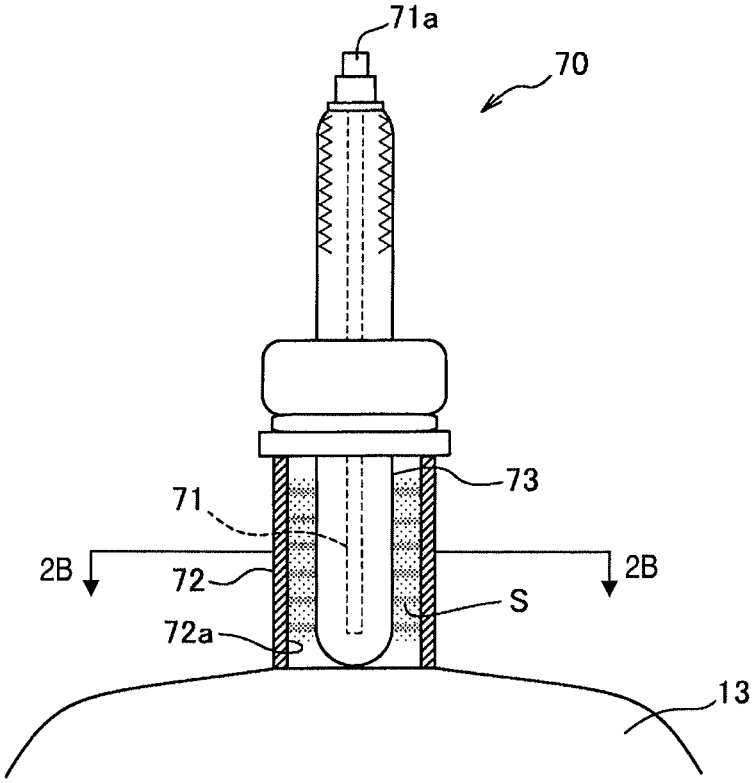
FIG. 2A is a partial cross-sectional view of the electric discharge device of the engine shown in FIG. 1.
Figure 2B:
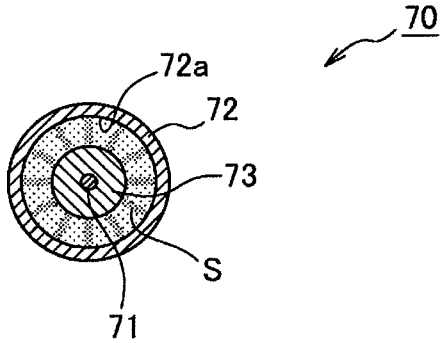
FIG. 2B is a cross-sectional view of the electric discharge device illustrated in FIG. 2A, taken along section line 2B-2B of FIG. 2A.

FIGS. 2A and 2B contain enlarged cross-sectional views of the non-equilibrium plasma discharge device 70. The non-equilibrium plasma discharge device 70 of the illustrated embodiment discharges non-equilibrium plasma by using a barrier discharge. Therefore, in this embodiment, the non-equilibrium plasma discharge device 70 is a barrier discharge device.

The non-equilibrium plasma discharge device 70 comprises a central electrode 71 and a tubular electrode 72. The central electrode 71 is a rod-shaped electrical conductor. The entire periphery of the central electrode 71 is covered by a dielectric material (insulating material) 73. The central electrode 71 is connected to the high-voltage high-frequency generator 80 via a terminal 71*a*. An AC voltage is applied to the central electrode 71 upon being generated by the high-voltage high-frequency generator 80. The value, application duration, AC frequency, application timing, and other characteristics of the AC voltage are controlled (set) according to the operating state of the engine 1.

The tubular electrode 72 is a tubular electrical conductor. The tubular electrode 72 is attached to the cylinder head. The inner periphery side of the tubular electrode 72 is a discharge chamber 72*a*. The central electrode 71 protrudes into the discharge chamber 72*a*. The central electrode 71 is provided on the top side of the substantial center of the combustion chamber. The center of the central electrode is substantially parallel to a line extending through the center of the combustion chamber. The distance from the central electrode 71 to the dielectric material and the distance from the dielectric material to the tubular electrode 72 are set to be substantially the same.

When an AC voltage is applied to the central electrode 71 from the high-voltage high-frequency generator 80, streamers S are generated between the tubular electrode 72 and the dielectric material 73 as shown in FIG. 2A. A plurality of streamers S is generated in the vertical direction as shown in FIG. 2A. The streamers are branched into thin streaks, and FIG. 2A shows a state in which six streamers are generated on both the right and left sides of the dielectric material 73. The streamers are also formed in a radial pattern about the dielectric material 73, as shown in FIG. 2B. FIG. 2B shows a state in which twelve streamers are formed in a radial pattern about the dielectric material 73. The non-equilibrium plasma discharge device 70 can generate a large amount of radicals in the discharge chamber 72*a* by forming a plurality of streamers S. It is also possible for multipoint simultaneous ignition, i.e., a volumetric ignition (hereinafter referred to as "volume ignition"), to occur within the discharge chamber.

Figure 3A:
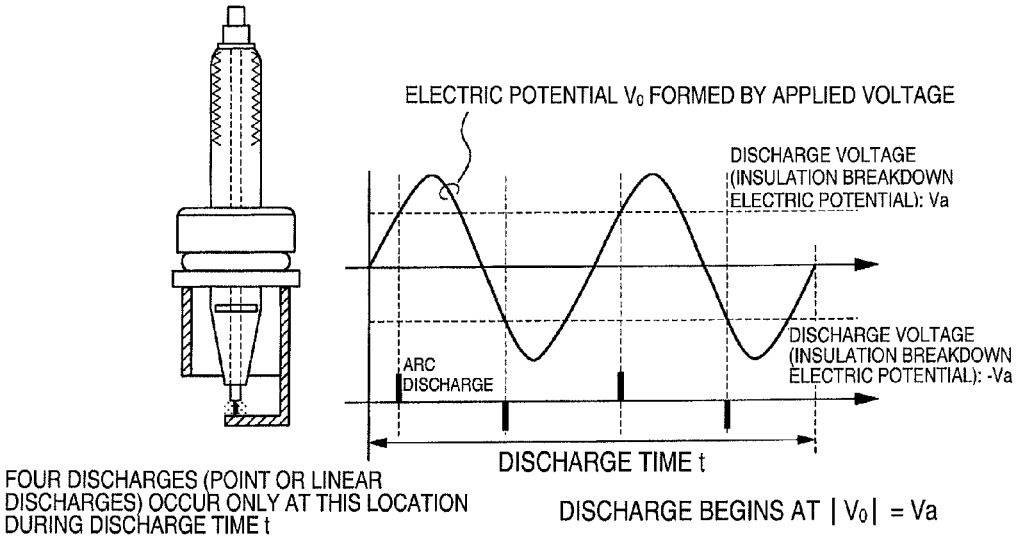
FIG. 3A is a diagram showing the electric discharges obtained when an AC voltage (electric potential) is applied to a spark ignition discharge mechanism in accordance with a comparative example of a conventional discharge mechanism.
Figure 3B:
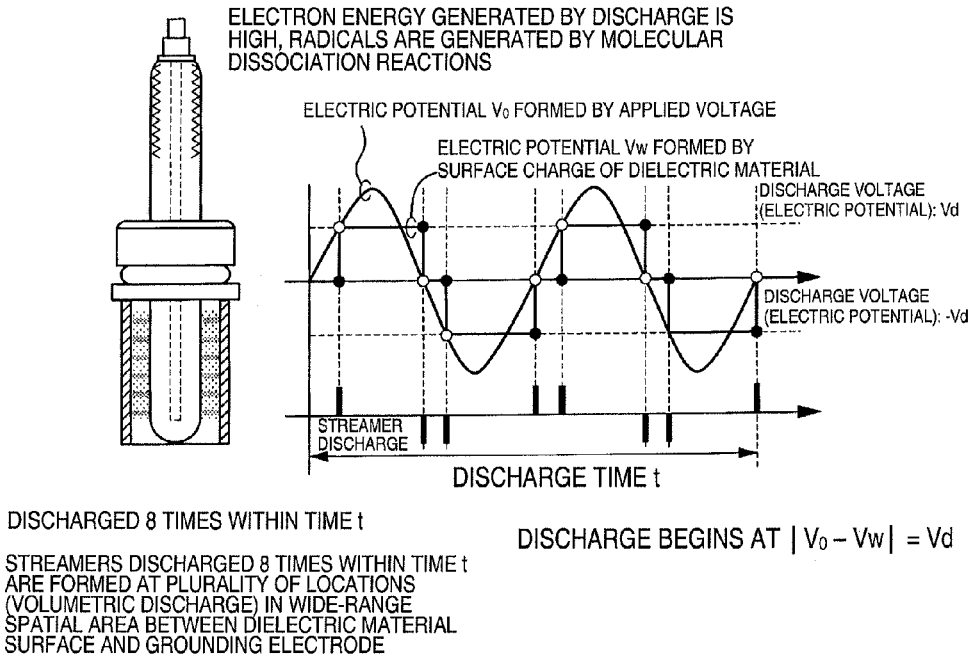
FIG. 3B is a diagram showing the electric discharges obtained when an AC voltage (electric potential) is applied to the electric discharge device in accordance with the first illustrated embodiment.

The non-equilibrium plasma discharge device 70 can perform multiple electric discharges within a predetermined time, whereby a large amount of radicals can be generated in the discharge chamber 72*a*. This will be described with reference to FIGS. 3A and 3B. FIGS. 3A and 3B contain diagrams showing the electric discharges obtained when an AC voltage (electric potential) is applied. FIG. 3A is a diagram showing the electric discharges obtained when an AC voltage (electric potential) is applied by a spark ignition discharge mechanism in accordance with a comparative example of a conventional discharge mechanism. FIG. 3B is a diagram showing the electric discharges obtained when an AC voltage (electric potential) is applied by the electric discharge device in accordance with the illustrated embodiment.

First, as a comparison, a case will be described in which an AC voltage is applied to the spark ignition discharge mechanism of a conventional sparkplug. In cases in which an AC voltage is applied to the sparkplug, an arc discharge occurs between the electrodes when the absolute value of an electric potential $V_0$ formed between the electrodes by the applied voltage reaches a discharge voltage (insulation breakdown electric potential) Va, as shown in FIG. 3A. Arc discharge similarly occurs when the polarity is inverted. With this sparkplug, four arc discharges occur within the discharge time t as shown in FIG. 3A. A discharge takes place in one location, and the form of the discharge is either point or linear.

In the non-equilibrium plasma discharge device 70, the dielectric material (insulating material) 73 covers the central electrode 7 1. The dielectric material 73 acts as a capacitor. After a barrier discharge (non-equilibrium plasma discharge) has occurred, an electric charge is accumulated on the surface of the dielectric material 73. The barrier discharge (non-equilibrium plasma discharge) occurs between the dielectric material 73 and the tubular electrode 72 when the absolute value of the difference between the electric potential V0 created by the applied voltage and the electric potential Vw created by the surface electric charge of the dielectric material 73 reaches a discharge voltage Vd, as shown in FIG. 3B. Therefore, streamers S are formed at a plurality of locations in the discharge chamber 72*a* in the non-equilibrium plasma discharge device 70, and eight barrier discharges (non-equilibrium plasma discharges) occur within the discharge time t, as shown in FIG. 3B.

Thus, the non-equilibrium plasma discharge device 70 can increase the number of discharges in the same time (discharge time t) to a greater level than that obtained with a sparkplug in a conventional method.

Though not shown in the drawings, the number of discharges can also be increased by increasing the voltage value of the AC voltage applied to the non-equilibrium plasma discharge device 70 because increasing the voltage value increases the likelihood that the absolute value of the difference between the electric potential $V_0$ created by the applied voltage and the electric potential Vw created by the surface electric charge of the dielectric material 73 will reach the discharge voltage Vd.

Figure 4:
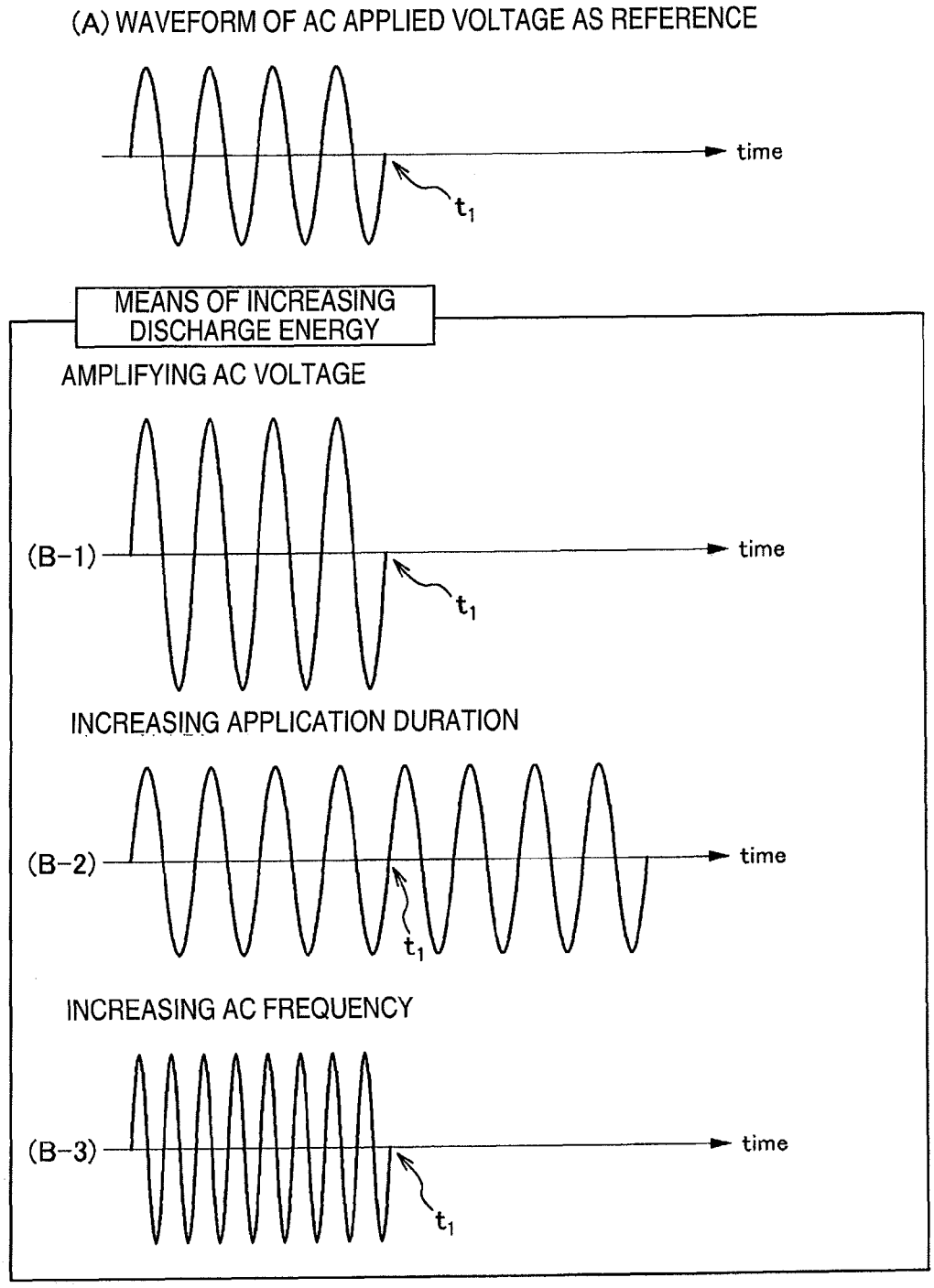
FIG. 4 is a diagram showing various methods for increasing the discharge energy of the electric discharge device.

FIG. 4 is a diagram showing various methods for increasing the discharge energy of the electric discharge device.

The discharge energy of the non-equilibrium plasma discharge device 70 is controlled by the voltage value, application duration, and AC frequency of the AC voltage from the high-voltage high-frequency generator 80. One method of increasing the discharge energy of the non-equilibrium plasma discharge device 70 is to increase the voltage value of the AC voltage in the manner shown in plot (B-1) of FIG. 4 relative to the waveform of a reference AC applied voltage (plot (A) of FIG. 4). The discharge energy of the non-equilibrium plasma discharge device 70 can also be increased by increasing the applied duration as in plot (B-2) of FIG. 4, or increasing the AC frequency as in plot (B-3) of FIG. 4.

Figure 5A:
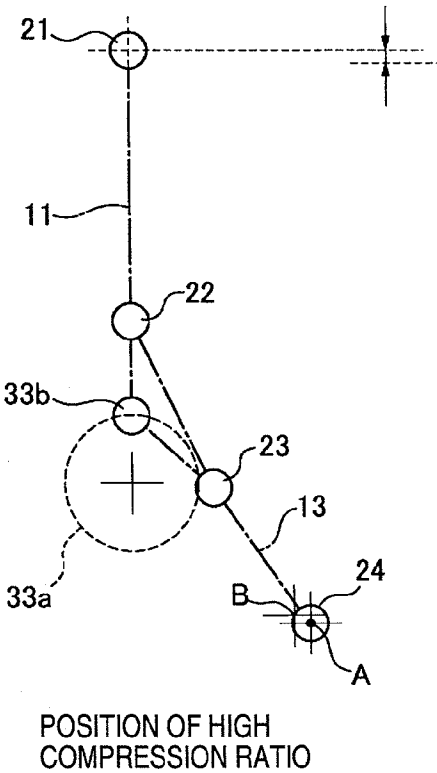
FIG. 5A is a simple link diagram showing the arrangement of a multi-link variable compression ratio mechanism at a high compression ratio.
Figure 5B:
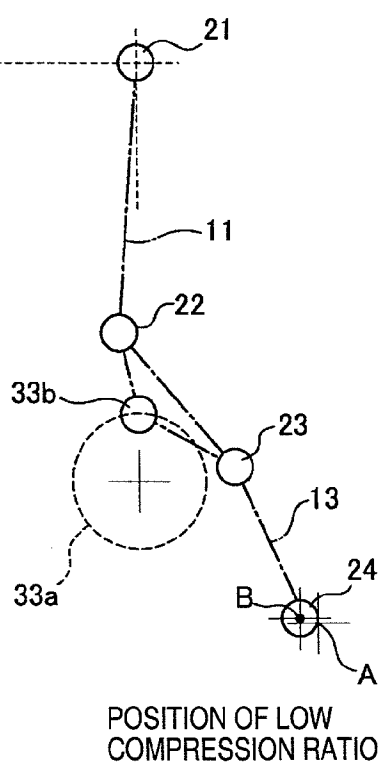
FIG. 5B is a simple link diagram showing the arrangement of the multi-link variable compression ratio mechanism at a low compression ratio.
Figure 5C:
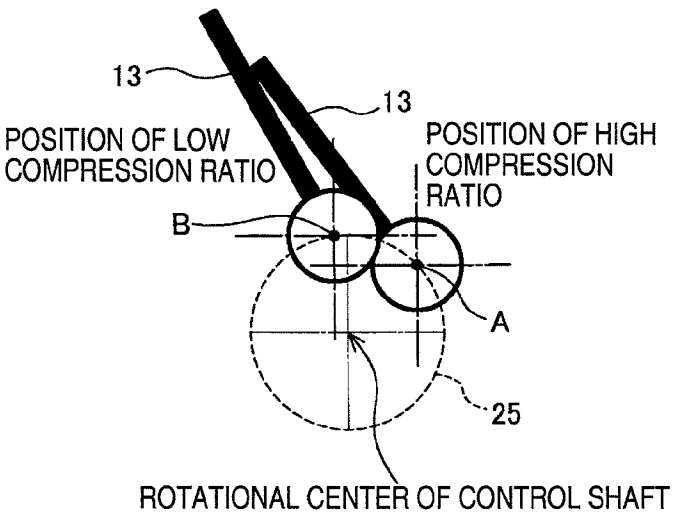
FIG. 5C is a simple link diagram showing the method for varying the compression ratio using the multi-link variable compression ratio mechanism.

FIGS. 5A-5C are simple link diagrams showing the arrangement of a multi-link variable compression ratio mechanism. With a multi-link variable compression ratio mechanism, the mechanical compression ratio can be varied by rotating the control shaft 25 and varying the position of the connecting pin 24. For example, if the connecting pin 24 is at position A as shown in FIG. 5C, the top dead center (TDC) is at a high level, resulting in a high compression ratio. If the connecting pin 24 is at position B as shown in FIGS. 5B and 5C, the control link 13 is pushed upward, and the position of the connecting pin 23 rises. The lower link 12 is thereby rotated counterclockwise around the crank pins 33*b*, the connecting pin 22 moves down, and the piston 32 in the piston top dead center (TDC) moves to a lower position. Therefore, the compression ratio is low.

Figure 6:
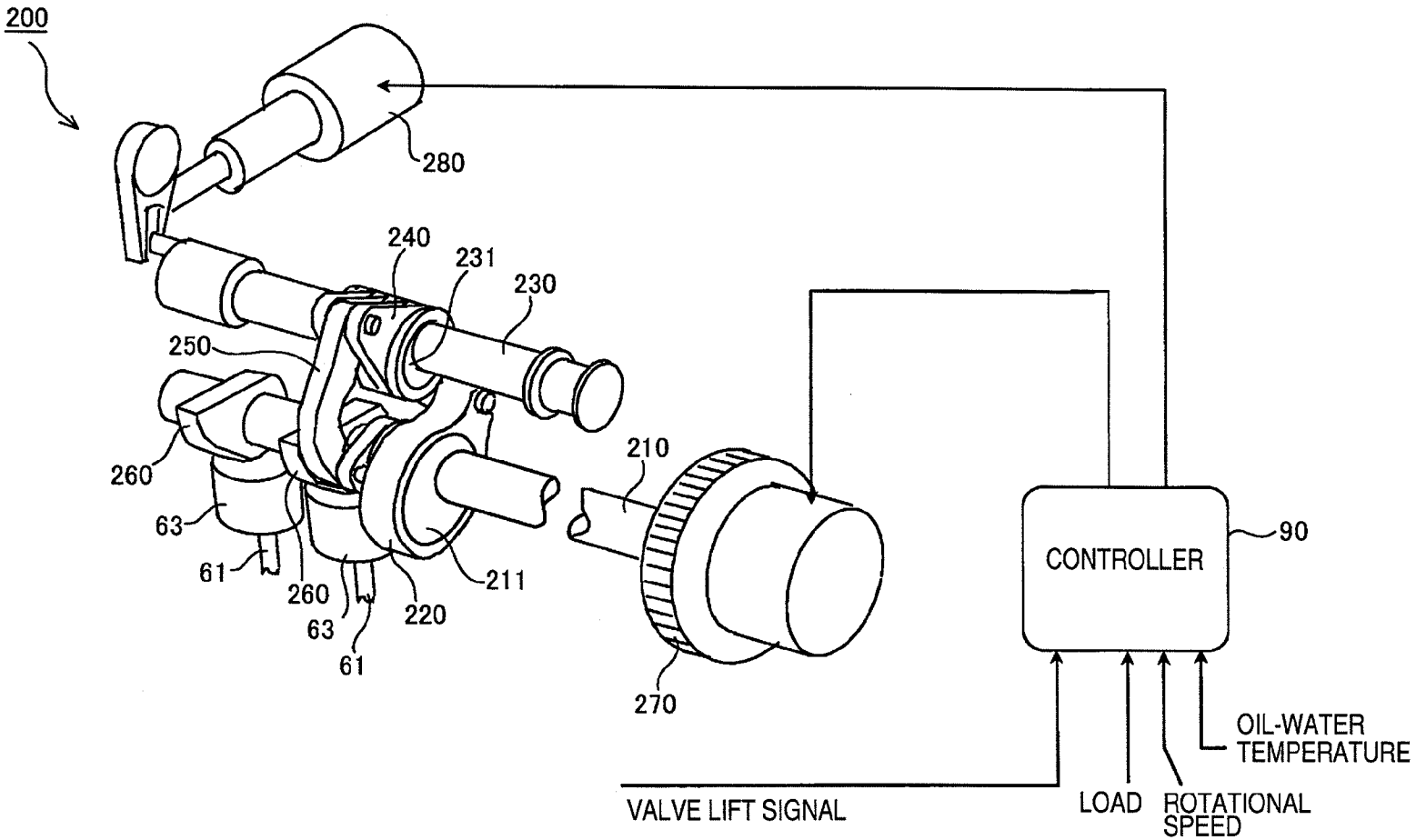
FIG. 6 is a perspective view of a variable valve timing mechanism for adjusting the opening and closing timing of a valve.

FIG. 6 is a perspective view showing a variable valve timing mechanism for adjusting the opening and closing period of a valve. The engine 1 further comprises a variable valve timing mechanism 200. The mechanism disclosed, for example, in Japanese Laid-Open Patent Application No. 11-107725 can be used as the variable valve timing mechanism 200. This is described with reference to the drawings.

The variable valve timing mechanism 200 comprises a camshaft 210, a link arm 220, a valve lift control shaft 230, a rocker arm 240, a link member 250, and oscillating cams 260. Cam followers 63 are pushed by the oscillation of the oscillating cams 260, thus opening and closing valves (intake valves) 61.

The camshaft 210 is rotatably supported at the top part of the cylinder head along the longitudinal direction of the engine. One end of the camshaft 210 is inserted through a cam sprocket 270. The cam sprocket 270 is rotated by the transmission of torque from the crankshaft 33 of the engine. The camshaft 210 rotates together with the cam sprocket 270. The camshaft 210 can rotate relative to the cam sprocket 270 by hydraulic pressure, and the phase of the camshaft 210 relative to the cam sprocket 270 can be thereby varied. This type of structure makes it possible to vary the rotational phase of the camshaft 210 relative to the crankshaft 33. A cam 211 is fixed to the camshaft 210. The cam 211 rotates integrally with the camshaft 210. The pair of oscillating cams 260 connected by pipes is inserted through the camshaft 210. The oscillating cams 260 oscillate about the camshaft 210 as a rotational center, causing the cam followers 63 to perform a stroke.

The link arm 220 is supported by the insertion of the cam 211. The valve lift control shaft 230 is disposed parallel to the camshaft 210. A cam 231 is formed integrally on the valve lift control shaft 230. The valve lift control shaft 230 is controlled by an actuator 280 so as to rotate within a predetermined range of rotational angles.

The rocker arm 240 is supported by the insertion of the cam 231 and is connected to the link arm 220. The link member 250 is connected to the rocker arm 240.

The camshaft 210 is inserted through the oscillating cams 260, which can oscillate about the camshaft 210. The oscillating cams 260 are connected to the link member 250. The oscillating cams 260 move up and down, pushing down on the cam followers 63 and opening and closing the valves 61.

Next, the action of the variable valve timing mechanism 200 will be described with reference to FIGS. 7A-7D.

Figure 7A:
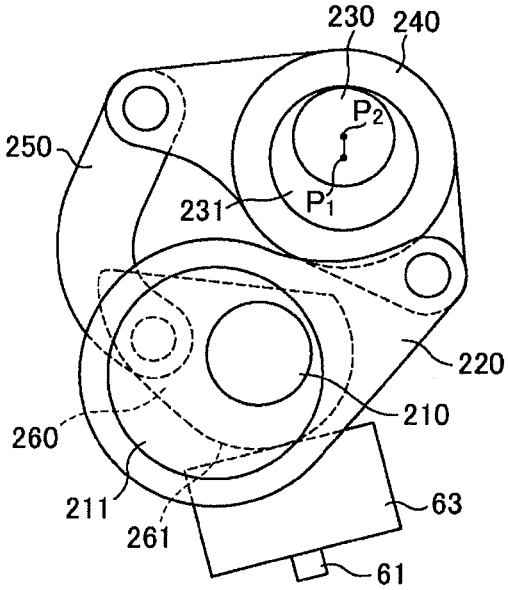
FIG. 7A is a simplified elevational view of the variable valve timing mechanism when valves are in a closed state.
Figure 7B:
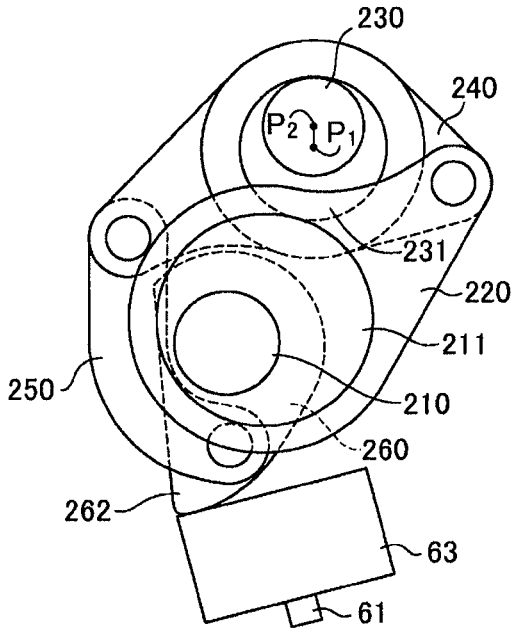
FIG. 7B is a simplified elevational view of the variable valve timing mechanism when the valves are in a state of maximum lift.

FIGS. 7A and 7B are views showing the manner in which the stroke amount of the cam followers 63 is maximized to maximize the lift amount of the valves 61. FIG. 7A shows the manner in which cam noses 262 are at their highest positions, and the oscillation direction of the oscillating cams 260 is inverted. At this time, the cam followers 63 are at their highest stroke positions, and the valves 61 are in a closed state. FIG. 7B shows the manner in which the cam noses 262 are at their lowest positions, and the oscillation direction of the oscillating cams 260 is inverted. At this time, the cam followers 63 are at bottom end positions of their strokes, and the valves 61 are in a state of maximum lift.

Figure 7C:
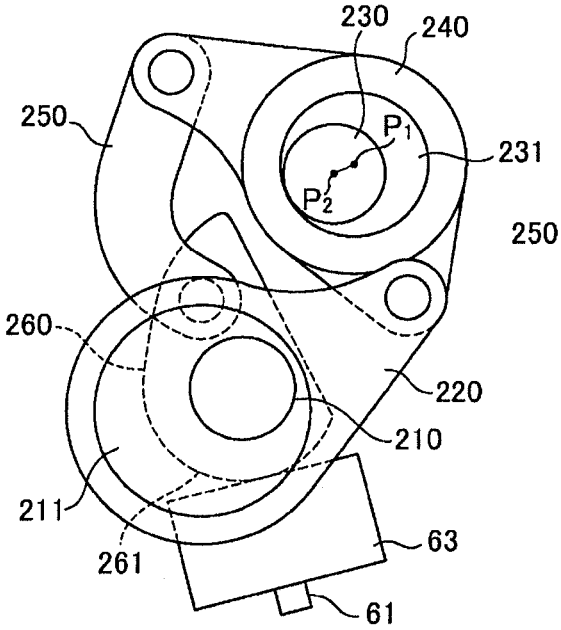
FIG. 7C is a simplified elevational view showing the variable valve timing mechanism when the stroke amount of cam followers is minimized, cam noses are at the highest position, and the valves are in a closed state.
Figure 7D:
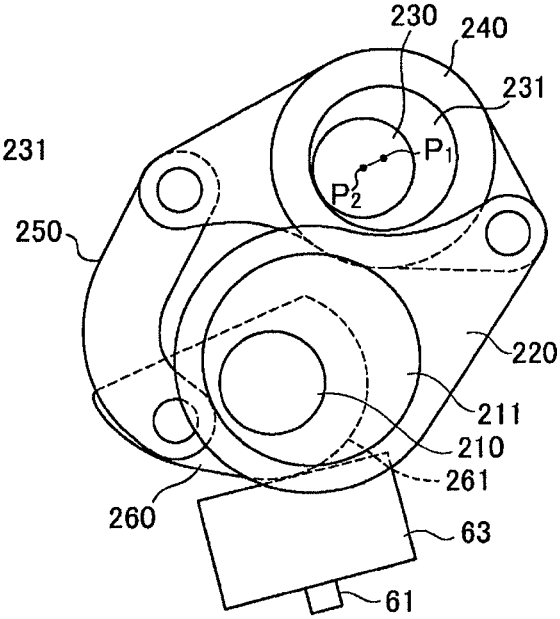
FIG. 7D is a simplified elevational view of the variable valve timing mechanism when the stroke amount of cam followers is minimized, the cam noses are at the lowest position, and the valves are in a closed state.

FIGS. 7C and 7D are views showing the manner in which the stroke amount of the cam followers 63 is minimized. FIG. 7C shows the manner in which the cam noses 262 are at their highest stroke positions and the oscillating direction of the oscillating cams 260 is inverted. FIG. 7D shows the manner in which the cam noses 262 are at their lowest positions and the oscillation direction of the oscillating cams 260 is inverted. In the present embodiment, the stroke amount of the cam followers 63 is zero, and the lift amount of the valves 61 is also zero. Therefore, in FIGS. 7C and 7D, the valves 61 are always in a closed state regardless of the action of the oscillating cams 260.

To increase the stroke amount of the cam followers 63 and the lift amount of the valves 61, the valve lift control shaft 230 is rotated to lower the position of the cam 231 and to set the axial center P1 below the axial center P2, as shown in FIGS. 7A and 7B. The entire rocker arm 240 is thereby moved downward.

When the camshaft 210 is rotatably driven in this state, the drive force is transmitted first to the link arm 220 and then to the rocker arm 240, the link member 250, and the oscillating cams 260.

When the cam 211 is to the left of the camshaft 210, as shown in FIG. 7A, the base-circle parts 261 of the oscillating cams 260 are in contact with the cam followers 63, at which time the cam followers 63 are at their highest stroke positions and the valves 61 are in a state of maximum lift.

When the cam 211 is to the right of the camshaft 210, as shown in FIG. 7B, the cam noses 262 of the oscillating cams 260 are in contact with the cam followers 63, at which time the cam followers 63 are at the bottom end positions of their strokes and the valves 61 are in an opened state.

To reduce the stroke amount of the cam followers 63 and the lift amount of the valves 61, the valve lift control shaft 230 is rotated to raise the position of the cam 231, and the axial center P1 is set above and to the right of the axial center P2, as shown in FIGS. 7C and 7D. The entire rocker arm 240 is thereby moved upward. When the camshaft 210 is rotatably driven in this state, the drive force is transmitted first to the link arm 220 and then to the rocker arm 240, the link member 250, and the oscillating cams 260. When the cam 211 is to the left of the camshaft 210, as shown in FIG. 7C, the base-circle parts 261 of the oscillating cams 260 are in contact with the cam followers 63. When the cam 211 is to the right of the camshaft 210, as shown in FIG. 7D, the base-circle parts 261 of the oscillating cams 260 are still in contact with the cam followers 63.

Thus, in cases in which the valve lift control shaft 230 is rotated such that the position of the cam 231 is raised and the axial center P1 is set above and to the right of the axial center P2, the cam followers 63 do not perform a stroke and the valves 61 remain closed, even though the camshaft 210 rotates and the oscillating cams oscillate.

Figure 8:
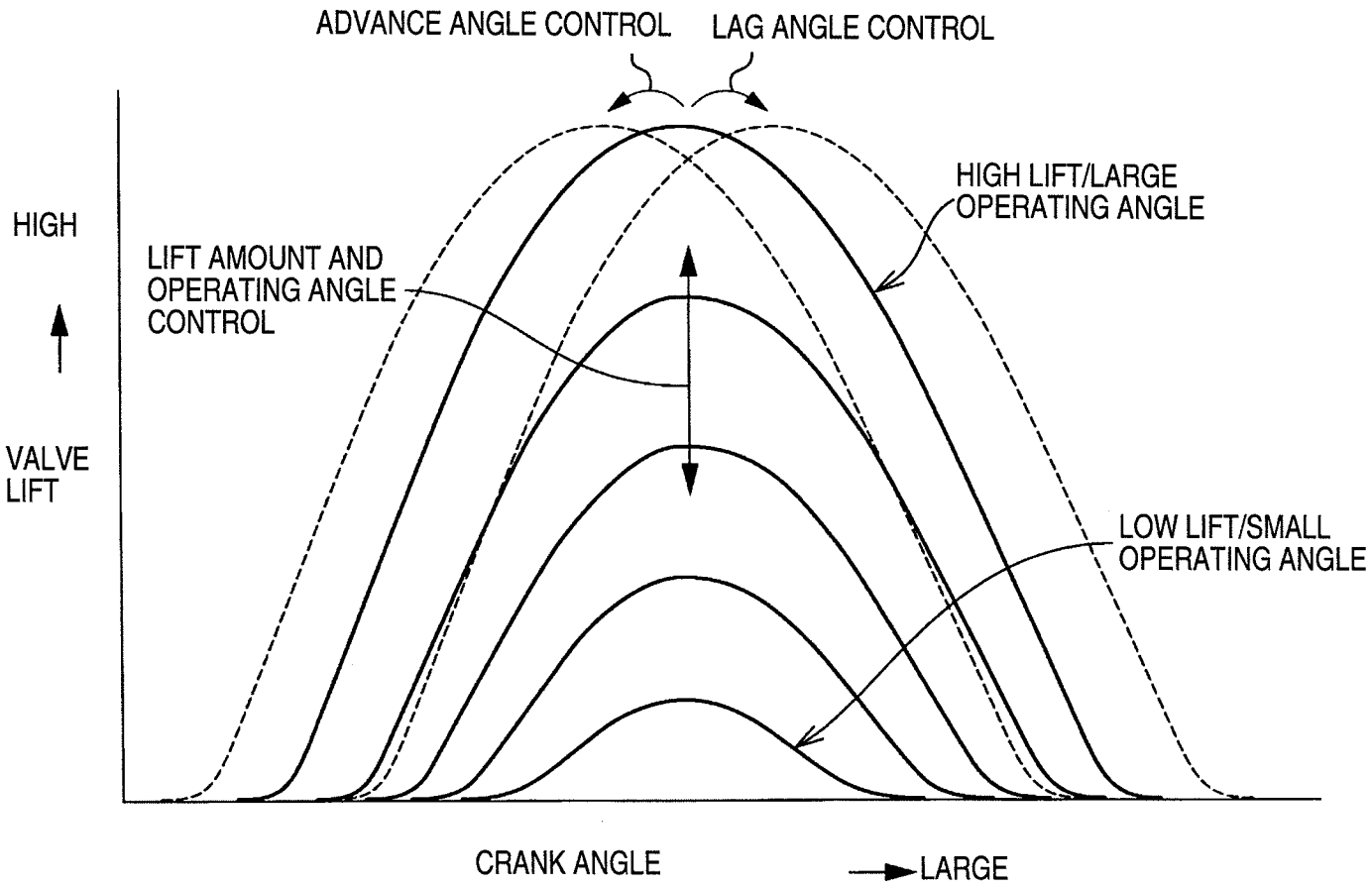
FIG. 8 is a graph showing the valve lift amount and the opening and closing timings in the variable valve timing mechanism.

FIG. 8 is a graph showing the valve lift amount and the opening and closing periods in the variable valve timing mechanism 200. The solid-lines curves indicate the lift amount and the opening and closing timings of the valves 61 when the valve lift control shaft 230 is rotated. The broken-line curves indicate the opening and closing periods of the valves 61 when the phase of the camshaft 210 is varied relative to the cam sprocket 270.

According to the structure of the variable valve timing mechanism 200 described above, the lift amount and operating angle of the valves 61 can be continually varied. Thus, the lift amount and operating angle of the valves 61 can be continually and freely varied by varying the angle of the valve lift control shaft 230 and the phase of the camshaft 210 relative to the cam sprocket 270.

Figures 9A, 9B, 9C, 9D, 9E:
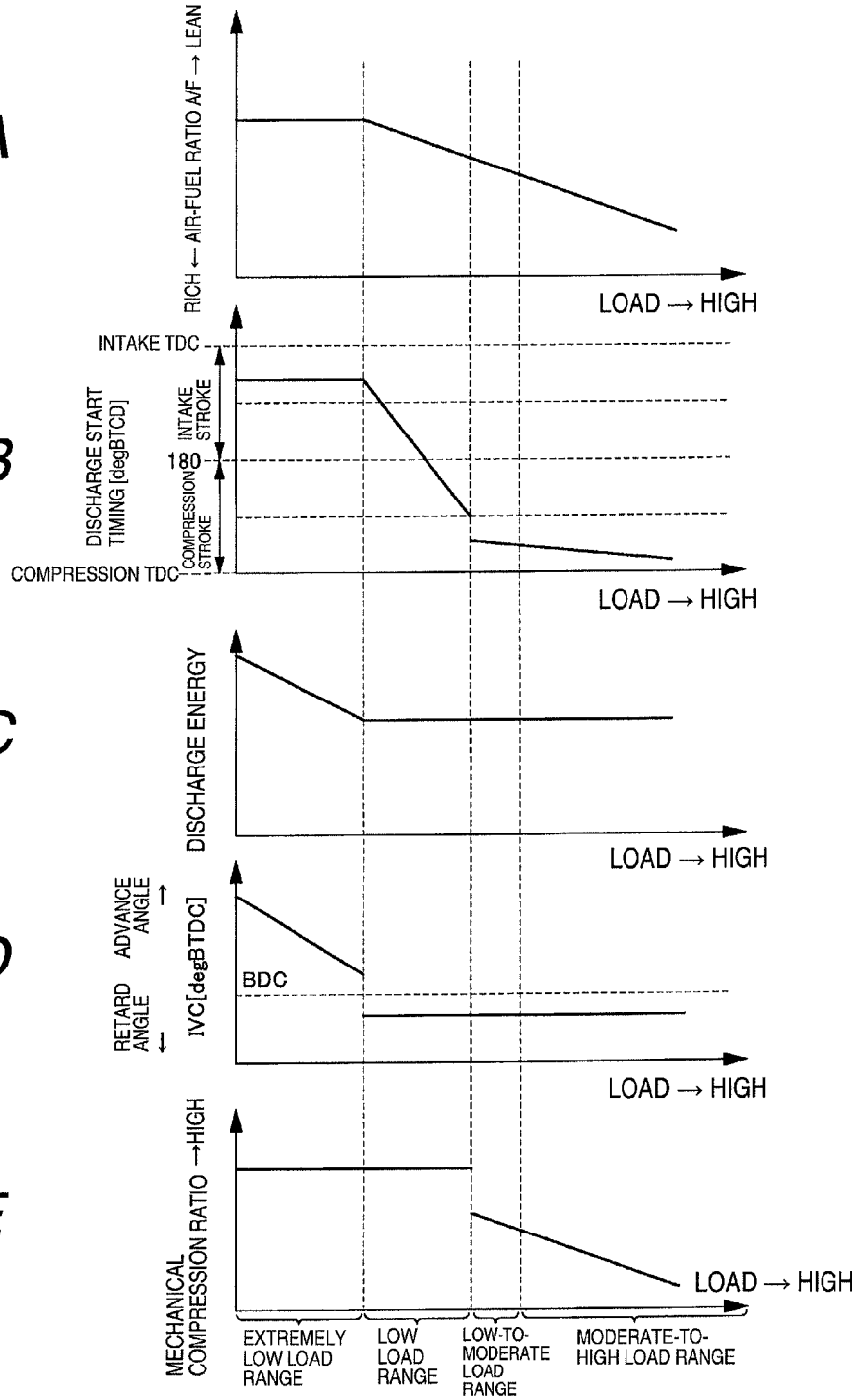
FIG. 9A is a graph showing the relationship of an air-fuel ratio to various operational states of the engine having the electric discharge device in accordance with the first embodiment.
FIG. 9B is a graph showing the relationship of a discharge start timing to various operational states of the engine having the electric discharge device in accordance with the first embodiment.
FIG. 9C is a graph showing the relationship of discharge energy to various operational states of the engine having the electric discharge device in accordance with the first embodiment.
FIG. 9D is a graph showing the relationship of an intake valve closed timing to various operational states of the engine having the electric discharge device in accordance with the first embodiment.
FIG. 9E is a graph showing the relationship of a mechanical compression ratio to various operational states of the engine having the electric discharge device in accordance with the first embodiment.

FIGS. 9A-9E are graphs showing an example of an operation map of the engine having a non-equilibrium plasma discharge function. The range of extremely low load (for example, the engine is an idol state) will now be discussed. When the load is in a range of extremely low load, the air-fuel ratio A/F is set to a constant value (FIG. 9A). Also, the discharge start timing is set to a constant timing during the intake stroke (FIG. 9B). The constant timing is set near the most advanced angle within the low load range described hereinafter. Thus, if the engine operates with a valve overlap during which both the intake valve and the exhaust valve are open, the start timing occurs after the exhaust valve has closed. If the engine operates without an overlap between the intake valve and the exhaust valve, the start timing occurs after the intake valve has opened. The end timing of the discharge is set to occur before the intake valve closes. The reasons for these settings will be explained below. The discharge energy is set to a level that increases the lower the load is (FIG. 9C). The intake valve close timing (IVC) is set to be more advanced than the bottom dead center (BDC), and the operation proceeds according to the Miller cycle. This timing IVC is set to be more advanced the lower the load is (FIG. 9D). The mechanical compression ratio is set to a high level (FIG. 9E).

The range of low load will now be discussed. In a low load range in which the load is greater than in the extremely low load range, the air-fuel ratio A/F is set to decrease (i.e., become richer) as the load increases (FIG. 9A). The discharge start timing is set to occur during the intake stroke when the load is low, retard as the load increases, and occur during the compression stroke when the load is high (FIG. 9B). The reasons for these settings are described hereinafter. The discharge energy is set to a constant value (FIG. 9C). The intake valve close timing (IVC) is set to a constant value more retarded than the bottom dead center (BDC) (FIG. 9D). The mechanical compression ratio is set to a high level (FIG. 9E).

The range of low to moderate load will now be discussed. In a low-to-moderate load range in which the load is greater than in the low load range, the air-fuel ratio A/F is set to decrease (i.e., become richer) as the load increases (FIG. 9A). The discharge start timing is set to be much more retarded than in the low load range, and is also set to become more retarded as the load increases (FIG. 9B). The discharge energy is set to a constant value (FIG. 9C). The intake valve close timing (IVC) is set to a constant value that is more retarded than the bottom dead center (BDC) (FIG. 9D). The mechanical compression ratio is set to be much less than in the extremely low load range or the low load range, and is also set to decrease as the load increases (FIG. 9E).

The range of moderate to high load will now be discussed. In a moderate-to-high load range in which the load is greater than in the low-to-moderate load range, the air-fuel ratio A/F is set to decrease (i.e., become richer) as the load increases (FIG. 9A). The discharge start timing is set to become more retarded as the load increases (FIG. 9B). The discharge energy is set to a constant value (FIG. 9C). The intake valve close timing (IVC) is set to a constant value that is more retarded than the bottom dead center (BDC) (FIG. 9D). The mechanical compression ratio is set to be even less than in the low-to-moderate load range, and is also set to decrease as the load increases (FIG. 9E).

The reasons for setting the control map in the above manner will be described herein. In the low load range, the discharge start timing is set to occur during the intake stroke when the load is low. When the load is particularly low within the low load region, the discharge start timing is set to occur after the intake valve has opened and the exhaust valve has closed. Thus, if the engine operates with a valve overlap during which both the intake valve and the exhaust valve are open, the start timing occurs after the exhaust valve has closed. If the engine operates without an overlap between the intake valve and the exhaust valve, the start timing occurs after the intake valve has opened. The end timing of the discharge occurs before the intake valve closes. The reasons for these settings will be explained with reference to FIG. 10.

Figure 10:
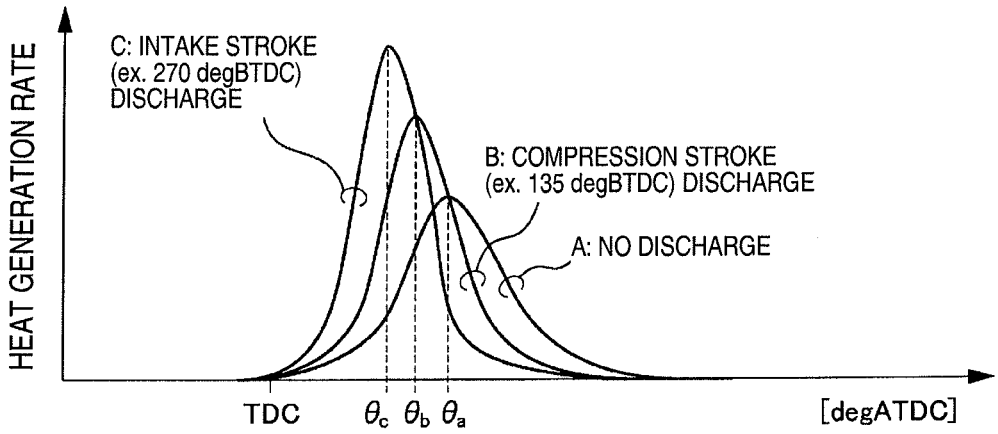
FIG. 10 is a graph showing the variation in the heat generation rate depending on if and when the non-equilibrium plasma discharge occurs.

FIG. 10 is a graph showing the variation in the heat generation rate depending on if and when the non-equilibrium plasma discharge occurs. Curve A in the diagram is shown as a comparative example, and is a curve indicating variation in the heat generation rate when a non-equilibrium plasma discharge is not performed (i.e., radicals are not generated). It can be seen from curve A that the peak of the heat generation rate occurs at a crank angle $\theta_a$. The heat generation rate is substantially symmetrical before and after this peak, and a crank angle MBθ 50% (discussed below) at which the mass combustion ratio is 50% substantially coincides with $\theta_a$.

Curve B in the diagram is a curve indicating variation in the heat generation rate when a non-equilibrium plasma discharge is initiated during the compression stroke (for example, 135 deg BTDC). It can be seen from curve B that the peak of the heat generation rate occurs at a crank angle $\theta_b$ at a more advanced level than the peak obtained when the non-equilibrium plasma discharge is not performed (curve A), and the heat generation rate rises more rapidly than when the non-equilibrium plasma discharge is not performed (curve A). The heat generation rate is substantially symmetrical before and after this peak, and the crank angle MBθ 50%, at which the mass combustion ratio is 50%, substantially coincides with $\theta_b$.

Curve C in the diagram is a curve indicating variation in the heat generation rate when a non-equilibrium plasma discharge is initiated during the intake stroke (for example, 270 deg BTCD). It can be seen from curve C that the peak of the heat generation rate occurs at a crank angle $\theta_c$ even more advanced than the peak obtained when the non-equilibrium plasma discharge is initiated during the compression stroke (curve B), and the variation in the heat generation rate is steep. The heat generation rate is substantially symmetrical before and after this peak, and the crank angle MBθ 50%, at which the mass combustion ratio is 50%, substantially coincides with $\theta_c$.

Figure 11A:
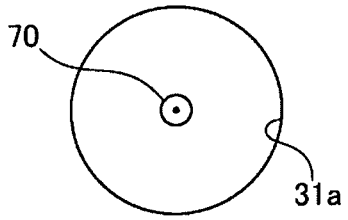
FIG. 11A is a drawing schematically depicting the state in which radicals are distributed within the cylinder when non-equilibrium plasma discharge does not occur.
Figure 11B:
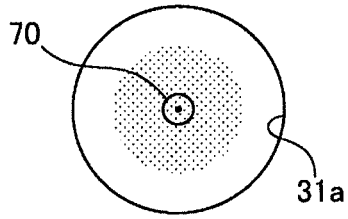
FIG. 11B is a drawing schematically depicting the state in which radicals are distributed within the cylinder when non-equilibrium plasma discharge is initiated during compression stroke.
Figure 11C:
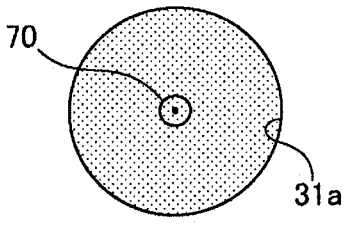
FIG. 11C is a drawing schematically depicting the state in which radicals are distributed within the cylinder when non-equilibrium plasma discharge is initiated during intake stroke.

FIGS. 11A-C contain drawings schematically depicting the state in which radicals are distributed within the cylinder and serve to illustrate the result of analyzing the reasons that bring about the curves shown in FIG. 10. The radicals are schematically depicted by the dots in the drawings. Research has shown that differences in the variation in the heat generation rate brought about by the discharge start timing (as shown in FIG. 10) are caused by the state in which radicals are distributed within the cylinder.

When a non-equilibrium plasma discharge is not performed (i.e., when radicals are not generated), there is naturally no distribution of radicals in the cylinder 31*a* (FIG. 11A). When the air-fuel mixture undergoes compression ignition while no radicals are distributed, the heat generation rate varies comparatively slowly, as shown by curve A in FIG. 10.

In cases in which a non-equilibrium plasma discharge is initiated during the intake stroke, it can be seen that radicals are distributed throughout substantially the entire cylinder 31*a* immediately before ignition, as shown in FIG. 11C. This is because there is a long period from the time when the non-equilibrium plasma discharge device 70 performs a non-equilibrium plasma discharge to generate radicals until the time of ignition, and the radicals are therefore carried by the intake flow to be widely dispersed throughout the cylinder 31*a*. When compression ignition takes place in the state in which the radicals are widely distributed, the air-fuel mixture combusts substantially all at once throughout the entire cylinder 31*a*. The radicals are in a state of molecular dissociation induced by collisions of high-energy electrons with fuel or air molecules. Such radicals have the characteristic of readily inducing oxidation reactions (i.e., combustion) and creating chain oxidation reactions. The radicals undergo combustion substantially all at once throughout the entire cylinder 31*a* when the pressure in the cylinder increases while radicals having such characteristics are dispersed throughout the entire cylinder 31*a*. Research has shown that the heat generation rate also rises suddenly because a combustion reaction takes place in this manner throughout the entire cylinder 31*a*.

Initiating a non-equilibrium plasma discharge during the compression stroke brings about an intermediate state in the cylinder 31*a* immediately before ignition, that is, a state between the case of no non-equilibrium plasma discharge (FIG. 11A) and the case in which a non-equilibrium plasma discharge is initiated during the intake stroke (FIG. 11C). In the intermediate state, fewer radicals are distributed in the vicinity of the non-equilibrium plasma discharge device 70 (FIG. 11B). This is because there is a short period from the time when the non-equilibrium plasma discharge device 70 performs a non-equilibrium plasma discharge to generate radicals until the time of ignition, and the radicals are therefore unable to widely disperse. When compression ignition takes place in the state in which the radicals are dispersed in the vicinity of the non-equilibrium plasma discharge device 70, the combustion process first involves the radicals and then spreads to the surrounding radical-free air-fuel mixture. As a result, curve B is an intermediate curve between curve A and curve C.

Figure 12:
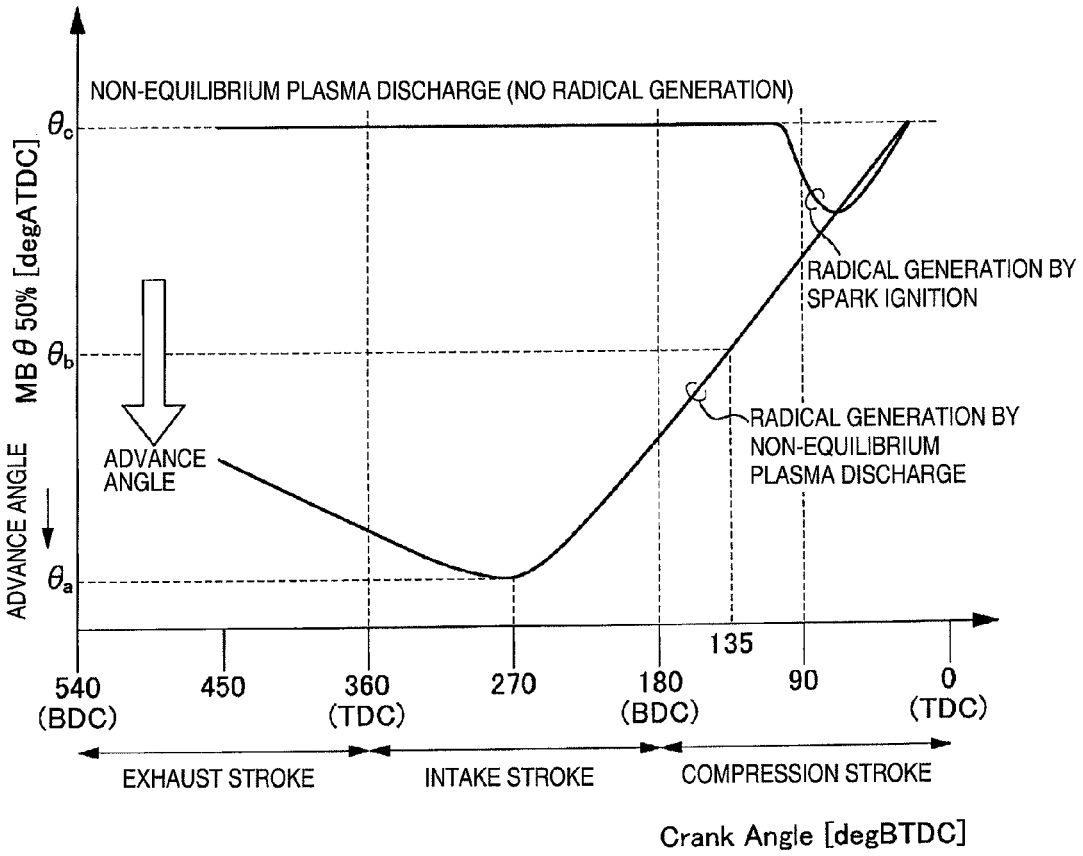
FIG. 12 is a graph showing the relationship between the discharge start timing and the crank angle at which the mass combustion ratio is 50%.

FIG. 12 is a graph showing the relationship between the discharge start timing and the crank angle at which the mass combustion ratio is 50%.

As described above, varying the non-equilibrium plasma discharge start timing causes a change in the crank angle MBθ 50% at which the mass combustion ratio is 50%. In other words, the autoignition properties change. This relationship is plotted in FIG. 12. Up until the discharge start timing reaches approximately 270 deg BTDC, the crank angle MBθ 50% at which the mass combustion ratio is 50% advances as the discharge start timing is advanced. In other words, autoignition properties are improved. When the discharge start timing is advanced to 270 deg BTDC or greater, the crank angle MBθ 50% at which the mass combustion ratio is 50% becomes more retarded as the discharge start timing is advanced.

The following are thought to be the reasons that the crank angle MBθ 50% at which the mass combustion ratio is 50% advances the farthest (i.e., autoignition properties are best) when the discharge start timing is approximately 270 deg BTDC. Specifically, there is an overlap between periods in which the intake valve and exhaust valve of the engine are normally opened and closed. It is believed that initiating a non-equilibrium plasma discharge after the exhaust valve has closed causes the air-fuel mixture drawn in through the intake valve to scatter more readily and autoignition properties to improve in comparison with a case in which a non-equilibrium plasma discharge is initiated during the period in which the exhaust valve has not yet closed. It is also believed that the air-fuel mixture more readily scatters and autoignition properties improve because the rate of air intake is higher during the latter half of the downward movement of the piston than the first half. The non-equilibrium plasma discharge device 70 continuously performs a non-equilibrium plasma discharge for a predetermined time (predetermined crank angle period) following discharge initiation. The air flow rate decreases after the intake valve is closed. When a non-equilibrium plasma discharge is performed while the air flow rate has decreased, the radicals do not disperse as readily as when the air flow rate is high. Therefore, to efficiently disperse radicals within the cylinder, the end period of the non-equilibrium plasma discharge is preferably before the closing of the intake valve.

As can be seen from FIG. 12, the heat generation timing (the crank angle MBθ 50% at which the mass combustion ratio is 50%) can be controlled by adjusting the discharge start timing. In other words, the autoignition properties of the air-fuel mixture can be controlled by adjusting the discharge start timing. As the autoignition properties improve, the operability at a lean air-fuel ratio improves as well. However, if the autoignition properties improve excessively when the air-fuel ratio is not particularly lean, there is a danger that knocking will occur. In view of this, the discharge start timing is preferably adjusted according to the air-fuel ratio (load).

As a comparative example, FIG. 12 also shows a case in which radicals are generated by a sparkplug. It is clear from the diagram that even if radicals are generated by a sparkplug, there is little difference from cases in which radicals are not generated.

Based on the above knowledge, the engine control apparatus is provided such that a non-equilibrium plasma discharge is initiated during the intake stroke so that radicals are widely distributed within the cylinder when the air-fuel ratio corresponds to an extremely diluted (lean) condition.

Depending on the operating state, there is a danger that the autoignition properties will be improved to an excess and that knocking will occur if the amount of radicals generated within the cylinder is too great or the radicals are too widely distributed. In view of this, the autoignition properties are adjusted to retard the discharge start timing as the load increases (as the amount of fuel increases and the air-fuel ratio corresponds to a richer mixture). The above factors are the reasons that the discharge start timing is set to occur during the intake stroke when the load is low, to become more retarded as the load increases, and to occur during the compression stroke when the load is high (FIG. 9B).

The mechanical compression ratio is set to a high level when the engine is operating in the low load region or the extremely low load region (FIG. 9E). The reasons for these settings will now be described.

An engine having a multi-link variable compression ratio mechanism has the characteristic of having a longer period in which the piston stays in proximity to the top dead center in comparison with a common engine in which the compression ratio is constant (hereinafter referred to as a "normal engine"). Due to this characteristic, an engine having a multi-link variable compression ratio mechanism, even at a high compression ratio, is less susceptible to knocking than a common engine is, comparatively high combustion energy can be obtained even with ultra-lean combustion, and stable combustion can be maintained.

Figure 13:
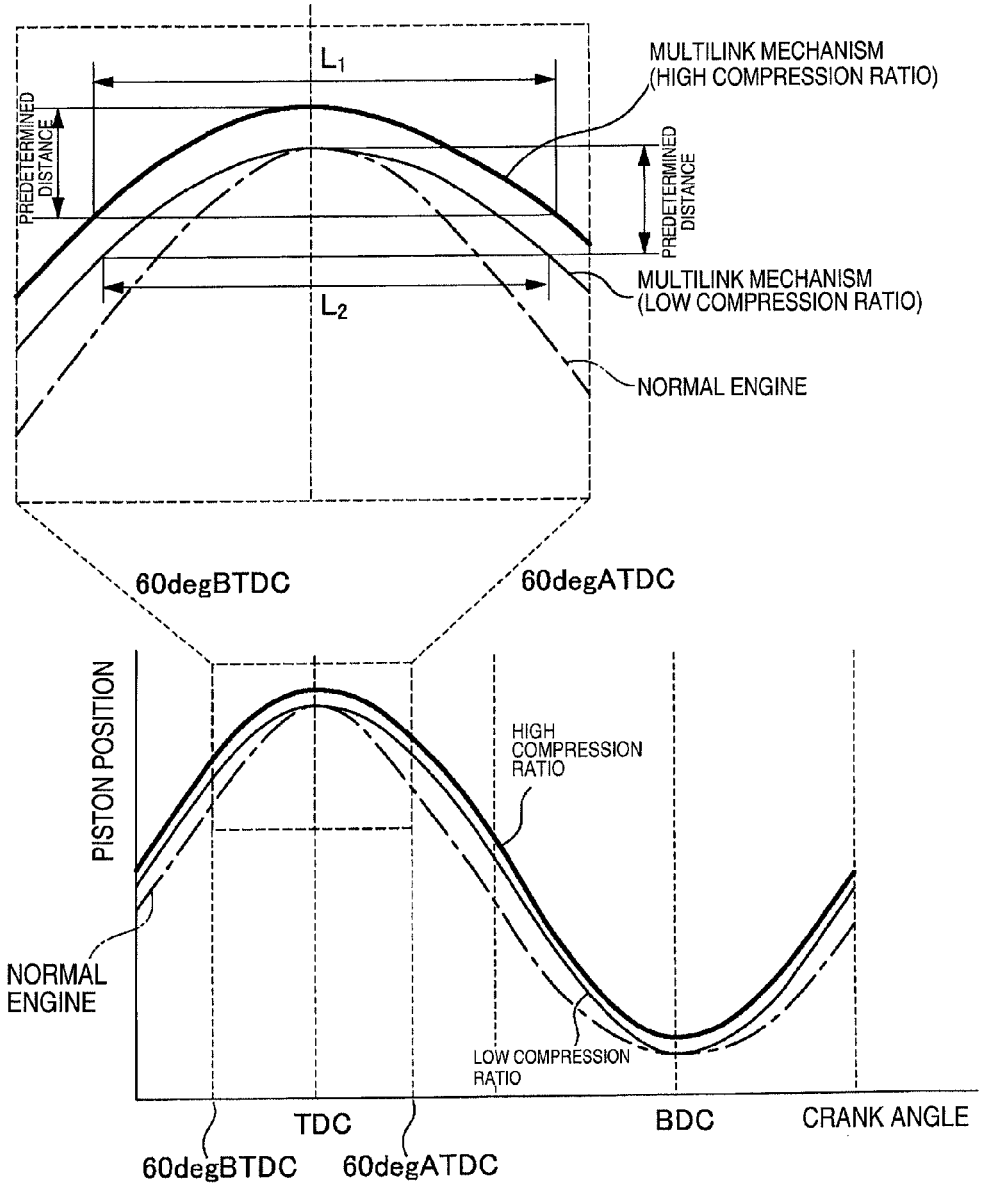
FIG. 13 is a graph showing the piston behavior in a multi-link variable compression ratio mechanism.

This aspect is described with reference to FIG. 13. FIG. 13 is a graph showing the piston behavior in a multi-link variable compression ratio mechanism, wherein the upper portion of FIG. 13 is an enlarged view of the dotted line portion of the lower portion of the figure. In FIG. 13, the thin solid-line curves indicate the piston behavior in a multi-link variable compression ratio mechanism engine having the same compression ratio as a normal engine.

If the time in which the piston is within a predetermined distance from the top dead center is defined as the period in which the piston is in proximity to the top dead center, it is clear from FIG. 13 that the multi-link variable compression ratio mechanism engine has a longer period in which the piston is in proximity to the top dead center than does a normal engine having the same compression ratio. Specifically, in the multi-link variable compression ratio mechanism engine, the period $L_1$ in which the piston is in proximity to the top dead center at a high compression ratio is longer than the period $L_2$ in which the piston is in proximity to the top dead center at a low compression ratio. In other words, the inequality $L_1>L_2$ is true in FIG. 13.

Thus, the multi-link variable compression ratio mechanism engine has a longer period in which the piston is in proximity to the top dead center than does a normal engine. Furthermore, the period in which the piston is in proximity to the top dead center is longer when the compression ratio is high. The fact that the piston is in proximity to the top dead center for a long time means that a high compression state is maintained for a long time during combustion. When a high compression state is maintained for a long time, knocking does not readily occur, and combustion is stable because comparatively high combustion energy can be obtained even during ultra-lean combustion.

Figure 14:
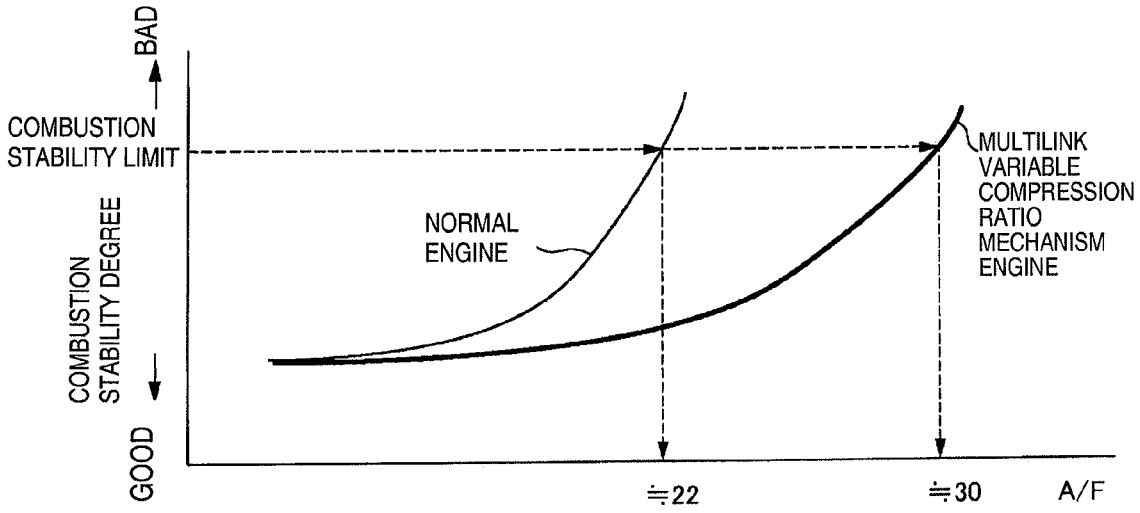
FIG. 14 is a graph showing the relationship between the air-fuel ratio and combustion stability.

Thus, the multi-link variable compression ratio mechanism engine has the characteristics shown in FIG. 14. FIG. 14 is a graph showing the relationship between the air-fuel ratio and combustion stability. The thin line in the diagram denotes a normal engine, and the thick line denotes a multi-link variable compression ratio mechanism engine.

As can be seen from FIG. 14, in a normal engine (compression ratio: about 8 to 12), the air-fuel ratio which can ensure combustion stability is about 22.

According to the multi-link variable compression ratio mechanism engine, the combustion stability limit is not compromised because the piston remains in proximity to the top dead center for a long time. Increasing the compression ratio (e.g., to about 18) makes it possible to obtain stable combustion even at an air-fuel ratio A/F of about 30. The above are the reasons the mechanical compression ratio is set to a high level in a load range at or below a low load (FIG. 9E). The map load range in FIG. 9 was set based on this knowledge.

Next, the reasons for selecting the settings in the extremely low load range in the control map will be described. In the extremely low load range, as described above, the intake valve close timing (IVC) is set to be more advanced than the bottom dead center (BDC), and the valve operation proceeds according to the Miller cycle. The timing is more advanced at lower loads (FIG. 9D). The filling efficiency of intake air is thereby reduced, the effective compression ratio is lowered, and pump loss is reduced. Since the combustion amount decreases with decreased load (the air-fuel ratio is substantially constant because the air intake amount also decreases), the air-fuel mixture loses autoignition properties. In view of this, the discharge energy is greatly increased at lower loads (FIG. 9C). The map of the extremely low load range in FIG. 9 was set based on the above knowledge. As shown, operation is possible even at extremely low load ranges.

Next, the reasons for the settings in the low-to-moderate load range of the control map will be described. In the low-to-moderate load range, as described above, the discharge start timing is retarded considerably in comparison to the low load range (FIG. 9B). The mechanical compression ratio is set to be much lower than in the extremely low and low load ranges (FIG. 9E).

Figure 15:
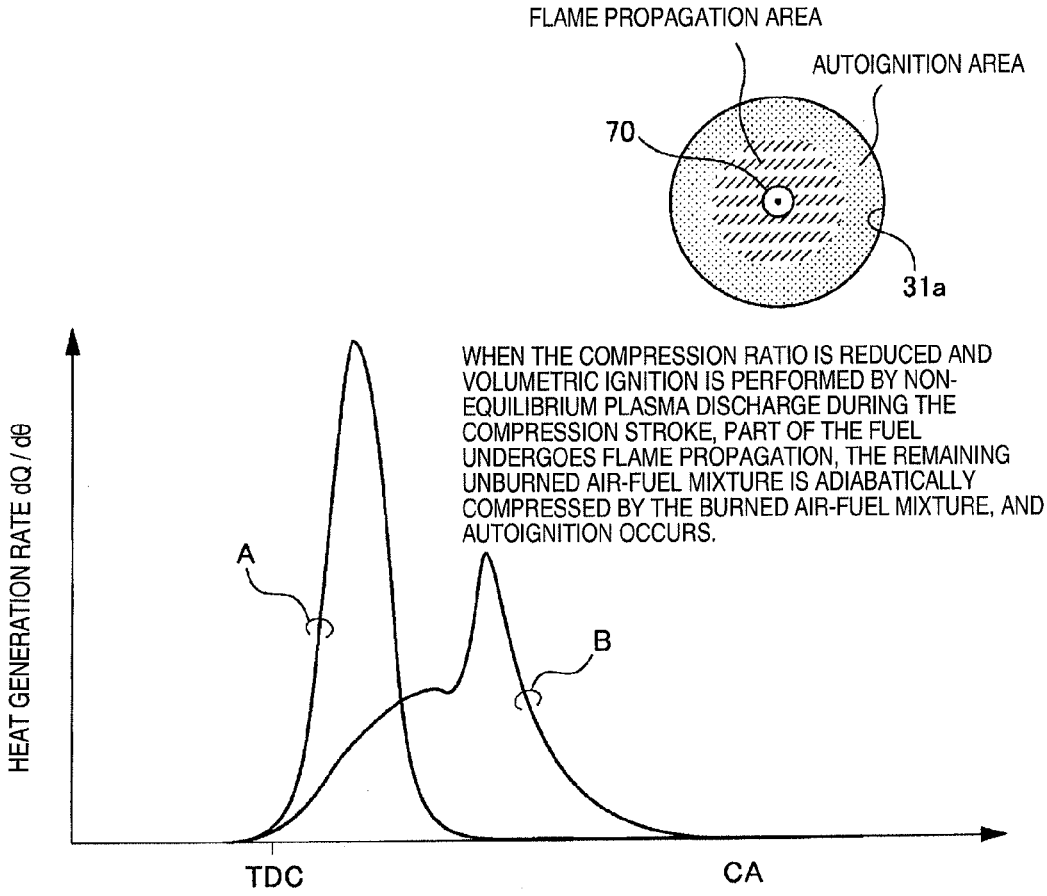
FIG. 15 is a graph showing the problems due to the heat generation rate suddenly increasing to an excessive degree, and the effects of the illustrated embodiment.

In cases in which radicals are generated and combustion takes place by compression ignition, the air-fuel mixture has better autoignition properties. Therefore, when the load is greater and the amount of combustion increases, there is a possibility that the heat generation rate will suddenly increase to an excessive degree, as shown by curve A in FIG. 15. When the heat generation rate suddenly increases to an excessive degree in this manner, there is a danger that knocking will occur.

In view of this, in the present embodiment, when the load increases to within a low-to-moderate load range, the compression ratio is reduced so that the air-fuel mixture does not undergo compression ignition. It is designed so that volumetric ignition is performed by the non-equilibrium plasma discharge device 70 during the compression stroke. The fuel in the vicinity of the non-equilibrium plasma discharge device 70 thereby undergoes flame propagation. The remaining unburned air-fuel mixture is adiabatically compressed by the burned air-fuel mixture and is made to undergo autoignition. As a result, knocking does not occur because the heat generation rate varies as shown by curve B in FIG. 15 and does not suddenly increase to an excessive degree. The map of the low-to-moderate load range in FIG. 9 is set based on the above. Operation is thereby made possible even in a low-to-moderate load range.

Spark ignition is performed by the non-equilibrium plasma discharge device 70 at a moderate-to-high load or greater, whereby operation is possible even in a moderate-to-high load range.

Figure 16A:
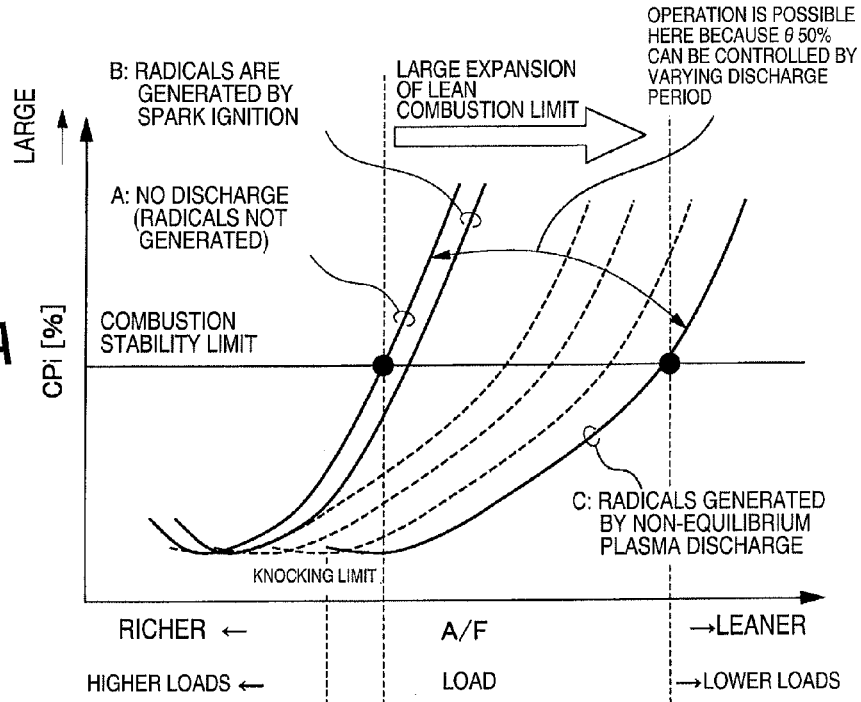
FIG. 16A is a graph showing the correlation between an air-fuel ratio and a fluctuation rate of the depicted average effective pressure.
Figure 16B:
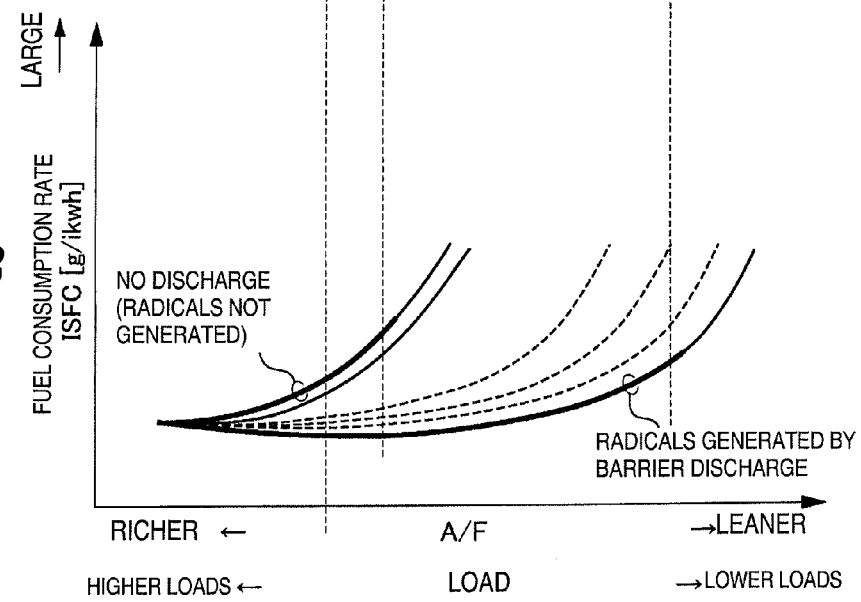
FIG. 16B is a graph showing that a fuel consumption rate can be reduced if a lean combustion limit is expanded.

FIGS. 16A and 16B are graphs showing various effects of the present embodiment. In the present embodiment, it is possible to greatly expand the lean combustion limit because the discharge start timing is appropriately controlled according to the operating state as described above.

In FIG. 16A, plotting the correlation between the air-fuel ratio A/F (horizontal axis) and a fluctuation rate CPi (vertical axis) of the depicted average effective pressure results in curve A in normal combustion by compression ignition. The lean combustion limit is an air-fuel ratio AFa.

Curve B depicts cases in which radicals are generated by a sparkplug, and combustion occurs by compression ignition. The lean combustion limit is an air-fuel ratio of AFb, and is somewhat leaner than the air-fuel ratio AFa of the lean combustion limit in normal cases.

Curve C depicts cases in which radicals are generated by the non-equilibrium plasma discharge device 70, and combustion occurs by compression ignition. The lean combustion limit is an air-fuel ratio of AFc. The lean combustion limit can be greatly expanded in comparison with the air-fuel ratio AFa of the lean combustion limit in normal cases and in comparison with the air-fuel ratio AFb of the lean combustion limit in generation of radicals by a sparkplug and combustion by compression ignition. As described above, the operation shown by the broken-line curves can be arbitrarily selected because it is possible to control the crank angle MBθ 50% at which the mass combustion ratio is 50% by adjusting the discharge start timing. If the lean combustion limit is expanded, the fuel consumption rate ISFC can be reduced as shown in FIG. 16B. The present embodiment makes it possible to reduce the fuel consumption rate and to improve fuel consumption, regardless of the load.

In the present embodiment, the central electrode and the dielectric material for covering the central electrode allow a non-equilibrium plasma discharge to generate radicals within a cylinder. Therefore, the autoignition properties of an air-fuel mixture during the compression stroke can be improved, the fuel consumption rate can consequently be reduced and fuel consumption can be improved, regardless of the load.

Second Embodiment

Figure 17:
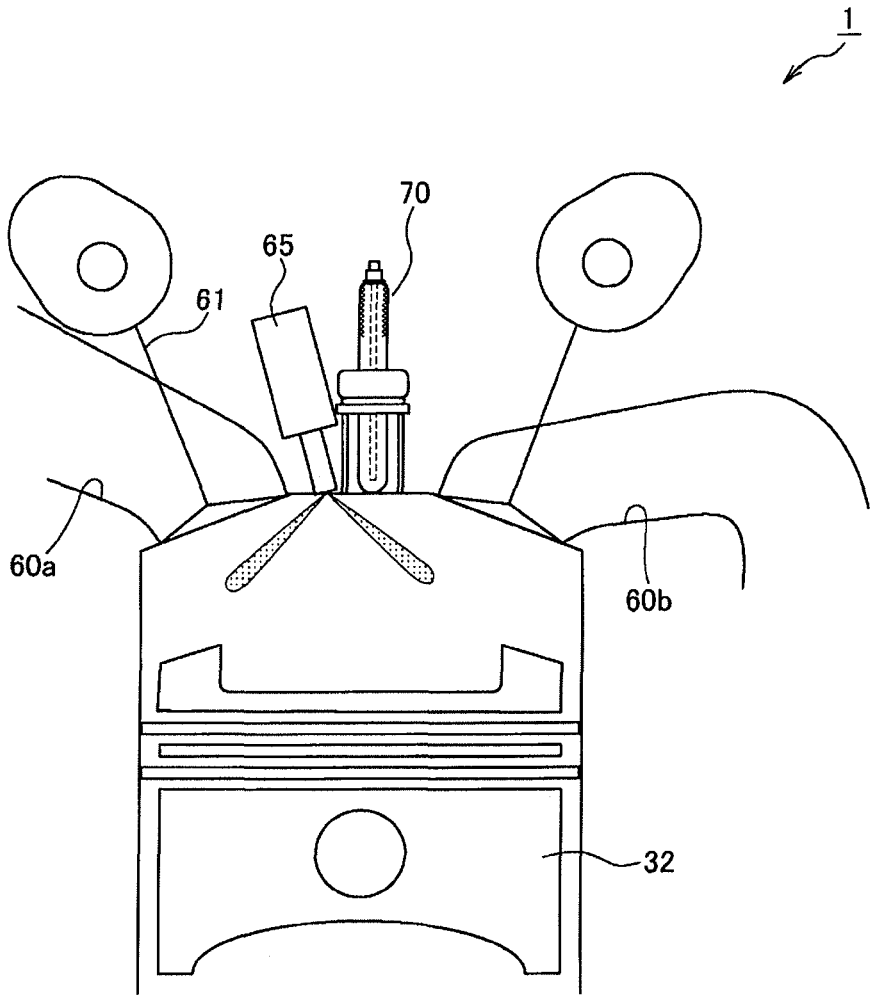
FIG. 17 is a simplified schematic cross-sectional view showing the operational configuration of the engine control apparatus having an electric discharge device in accordance with a second embodiment.

Referring now to FIG. 17, an engine control apparatus in accordance with a second embodiment will now be explained. Basically, in this second embodiment, the engine control apparatus of the first embodiment is replaced in FIG. 1 with a modified structure as discussed below. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment can be omitted for the sake of brevity.

FIG. 17 is a simplified schematic cross-sectional view showing the operational configuration of the engine control apparatus having an electric discharge device in accordance with a second embodiment. The engine 1 having a non-equilibrium plasma discharge function of the first embodiment was a so-called port-injection engine in which the fuel injection valve 65 was provided to the intake port, but the electric discharge device can also be applied to a direct fuel-injection engine such as the one shown in FIG. 17, in which fuel is directly injected into the cylinder.

Figure 18:
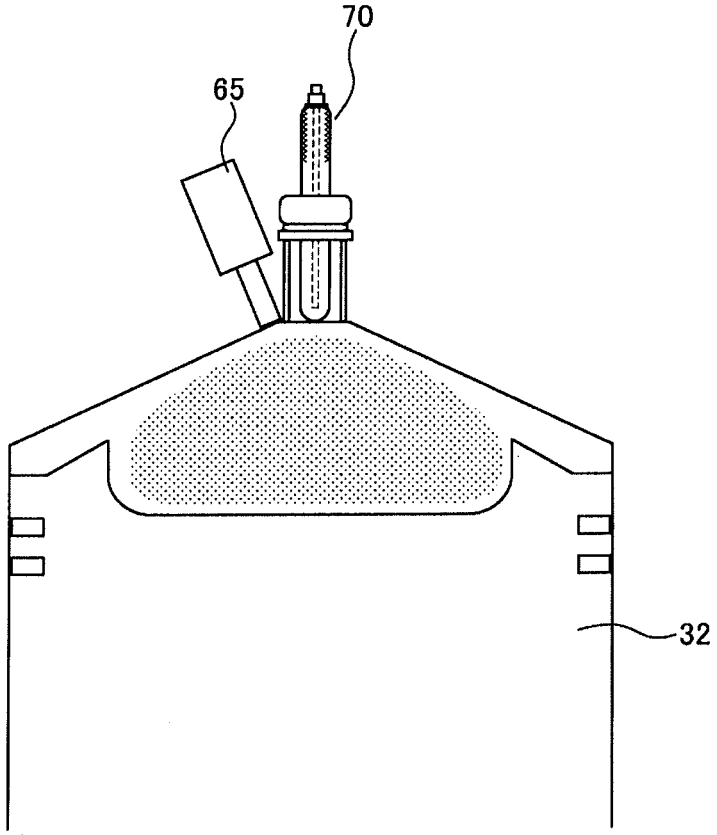
FIG. 18 is a simplified schematic cross-sectional view of a portion of the engine showing the manner in which fuel is injected into the engine in accordance with the second embodiment.

In this type of direct fuel-injection engine, the air-fuel mixture is stratified only in the vicinity of the non-equilibrium plasma discharge device 70 as shown in FIG. 18 to make operation possible even with a lean air-fuel ratio. Generating radicals in this type of lean air-fuel mixture allows the lean combustion limit to be expanded, the fuel consumption rate to be reduced, and fuel consumption to be improved.

An example of an operation map for the engine having such a barrier discharge function is shown in FIGS. 19A-19E. An interval in which a non-equilibrium plasma discharge is not performed is provided in the vicinity of a comparatively high load within the low load range (FIGS. 19A and 19B). In the low load range, a high compression ratio is set by the variable compression ratio mechanism, and knocking does not readily occur. Therefore, there is an operation range in which lean combustion is possible even though a non-equilibrium plasma discharge is not performed. When a non-equilibrium plasma discharge is performed in such an operating range, there is a danger that autoignition properties will improve excessively and that knocking will occur. In view of this, a non-equilibrium plasma discharge is not performed in the vicinity of comparatively high loads within the low load range.

In an extremely low load range in which the load is lower than in the low load range, a stratified operation is performed (FIG. 19D) and the air-fuel ratio A/F is made leaner (sparser) according to the load (FIG. 19A). A non-equilibrium plasma discharge is performed because the autoignition properties must be improved along with the increase in sparseness of the air-fuel mixture. The discharge start timing is set to occur during the intake stroke, wherein the effects of autoignition properties improvement are high (FIG. 19B). The autoignition properties are improved by increasing the discharge energy along with the increase in sparseness (FIG. 19C).

By using the present embodiment, the invention can be carried out even with a direct fuel-injection engine, the fuel consumption rate can be reduced and fuel consumption can be improved, regardless of the load.

Third Embodiment

Figure 20:
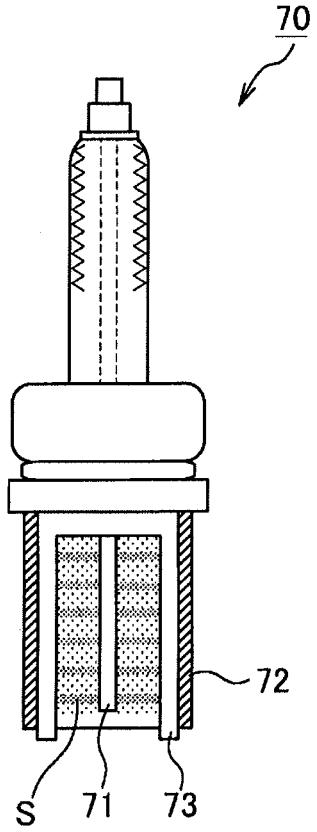
FIG. 20 is a partial cross-sectional view showing the operational configuration of the engine having an electric discharge device in accordance with a third embodiment.

Referring now to FIG. 20, an engine control apparatus in accordance with a third embodiment will now be explained. Basically, in this third embodiment, the engine control apparatus of the first embodiment is replaced in FIG. 1 with a modified structure as discussed below. In view of the similarity between the first and second embodiments, the parts of the third embodiment that are identical to the parts of the first embodiment will be given the same reference numerals as the parts of the first embodiment. Moreover, the descriptions of the parts of the third embodiment that are identical to the parts of the first embodiment can be omitted for the sake of brevity.

FIG. 20 is a simplified schematic cross-sectional view showing the third embodiment of the engine control apparatus having an electric discharge device. In the non-equilibrium plasma discharge device 70 of the present embodiment, a dielectric layer (insulating layer) 73 is formed on the inner periphery of the tubular electrode 72, and the central electrode 71 is exposed. The distal end of the dielectric layer (insulating layer) 73 preferably protrudes farther toward the combustion chamber than does the distal end of the tubular electrode 72 or the distal end of the central electrode 71. This is because such a configuration makes it possible to suppress the occurrence of a thermal plasma discharge between the distal end of the tubular electrode 72 and the distal end of the central electrode 71, even in cases in which the discharge energy of a non-equilibrium plasma discharge has been increased. The dielectric layer 73 acts as a capacitor in the configuration of the present embodiment, and the same effects as in the first embodiment are obtained.

Fourth Embodiment

Figure 21A:
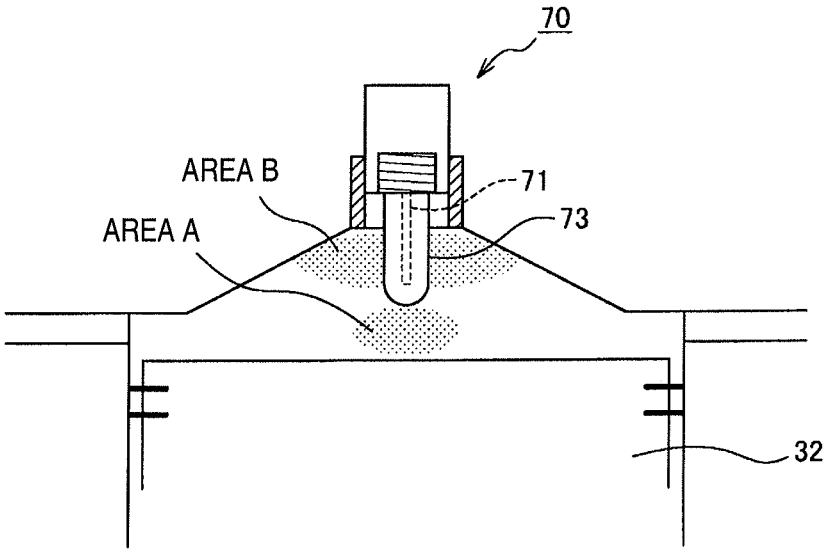
FIG. 21A is a partial cross-sectional view showing the operational configuration of the engine having an electric discharge device in accordance with a fourth embodiment where a barrier discharge is formed within a combustion chamber.
Figure 21B:
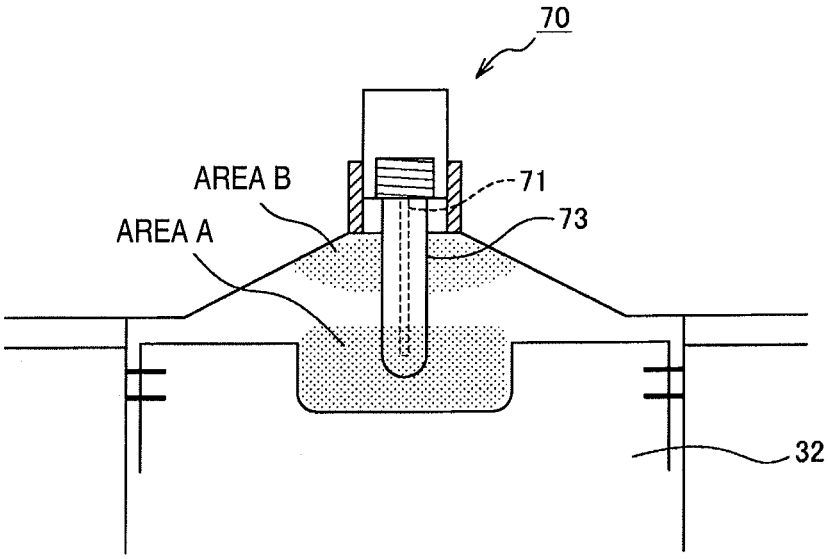
FIG. 21B is a partial cross-sectional view showing the operational configuration of the engine having an electric discharge device in accordance with a fourth embodiment where a barrier discharge is formed within a concave part of a top surface of a piston.

Referring now to FIGS. 21A and 21B, an engine control apparatus in accordance with a fourth embodiment will now be explained. Basically, in this fourth embodiment, the engine control apparatus of the first embodiment is replaced in FIG. 1 with a modified structure as discussed below. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment can be omitted for the sake of brevity.

FIGS. 21A and 21B contain simplified schematic cross-sectional views showing the fourth embodiment of the engine control apparatus having an electric discharge device. In the non-equilibrium plasma discharge device 70 of the present embodiment, in contrast to the first embodiment, the central electrode 71 protrudes into the combustion chamber.

Thus, the non-equilibrium plasma discharge device 70 performs a non-equilibrium plasma discharge within the combustion chamber as shown in FIG. 21A. In the present embodiment, the top surface of the piston 32 or the inside wall surface of the cylinder head functions as an electrode. Specifically, in the present embodiment, a non-equilibrium plasma discharge is performed and radicals are generated in the area A between the top surface of the piston 32 and the dielectric layer (insulating layer) 73 of the central electrode 71, or in the area B between the inside wall surface of the cylinder head and the dielectric layer (insulating layer) 73. Whether the non-equilibrium plasma discharge is performed in area A or B is determined by the position of the piston 32 when an AC voltage is applied to the non-equilibrium plasma discharge device 70. In view of this, the discharge area of non-equilibrium plasma discharge can be selected by controlling the application timing of the AC voltage applied to the non-equilibrium plasma discharge device 70.

A concave part can be formed in the top surface of the piston 32 as shown in FIG. 21B, and the configuration can be designed so that non-equilibrium plasma discharge is performed between the concave part and the distal end of the dielectric material (insulating material) 73 of the central electrode 71.

Fifth Embodiment

Figure 22A:
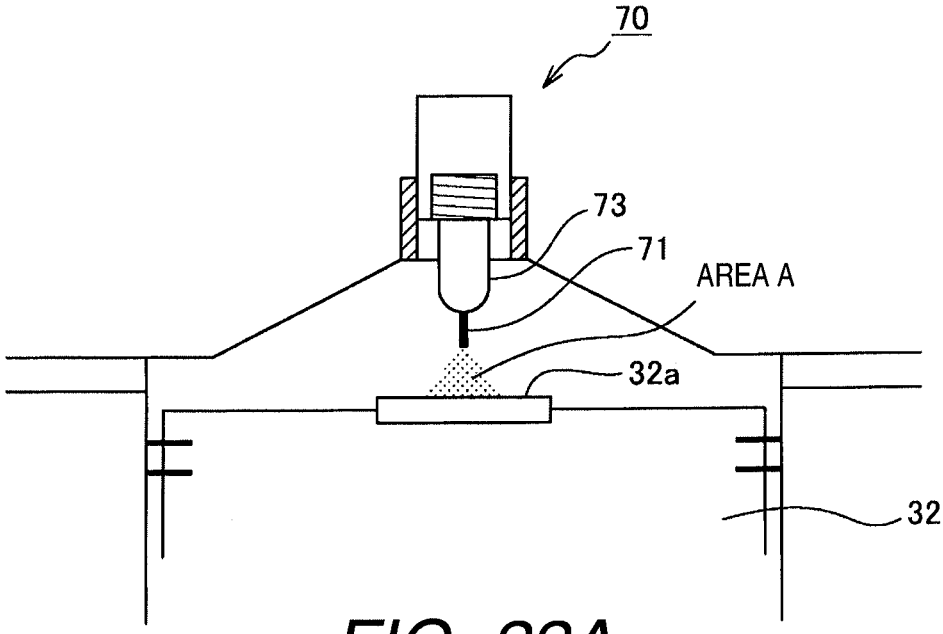
FIG. 22A is a partial cross-sectional view showing the operational configuration of the engine having an electric discharge device in accordance with a fifth embodiment where a barrier discharge is formed within a combustion chamber.
Figure 22B:
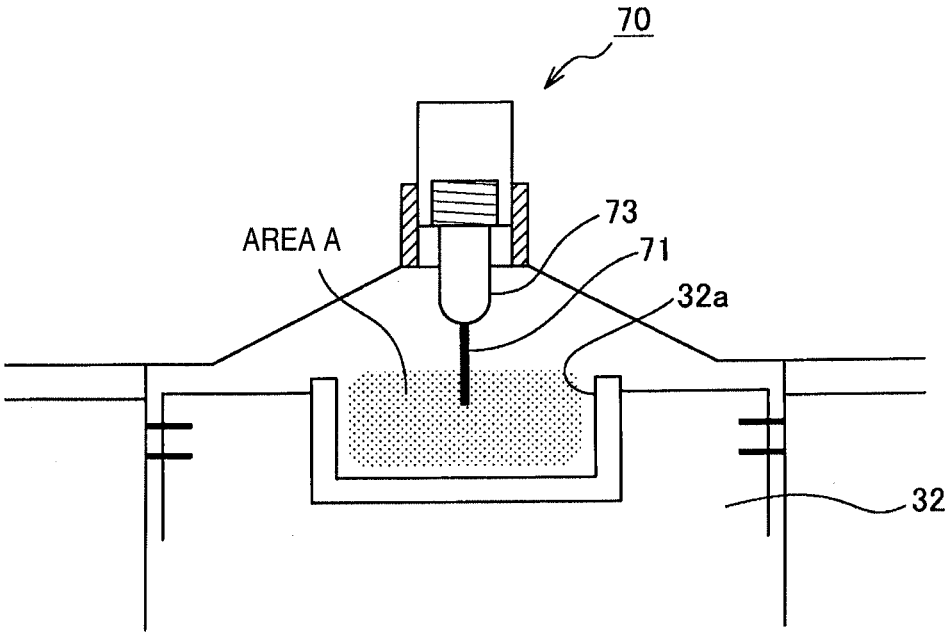
FIG. 22B is a partial cross-sectional view showing the operational configuration of the engine having an electric discharge device in accordance with a fifth embodiment where a barrier discharge is formed within a concave part of a top surface of a piston.

Referring now to FIGS. 22A and 22B, an engine control apparatus in accordance with a fifth embodiment will now be explained. Basically, in this fifth embodiment, the engine control apparatus of the first embodiment is replaced in FIG. 1 with a modified structure as discussed below. In view of the similarity between the first and fifth embodiments, the parts of the fifth embodiment that are identical to the parts of the first embodiment will be given the same reference numerals as the parts of the first embodiment. Moreover, the descriptions of the parts of the fifth embodiment that are identical to the parts of the first embodiment can be omitted for the sake of brevity.

FIGS. 22A and 22B contain simplified schematic cross-sectional views showing the fifth embodiment of the engine control apparatus having an electric discharge device. In the non-equilibrium plasma discharge device 70 of the present embodiment, the dielectric material (insulating material) 73 is shorter in comparison with the fourth embodiment, and the central electrode 71 is exposed within the combustion chamber. A dielectric layer (insulating layer) 32*a* is also formed on the top surface of the piston 32.

Thus, the non-equilibrium plasma discharge device 70 performs a non-equilibrium plasma discharge within the combustion chamber as shown in FIG. 22A. Specifically, a non-equilibrium plasma discharge is performed and radicals are generated in the area A between the distal end of the central electrode 71 and the dielectric layer (insulating layer) 32*a* on the top surface of the piston 32.

If a concave part is formed in the top surface of the piston 32, and the dielectric layer (insulating layer) 32*a* is formed in the inner periphery of the concave part as shown in FIG. 22B, a non-equilibrium plasma discharge is performed between the dielectric layer (insulating layer) 32*a* and the distal end of the central electrode 71.

Sixth Embodiment

Figure 23:
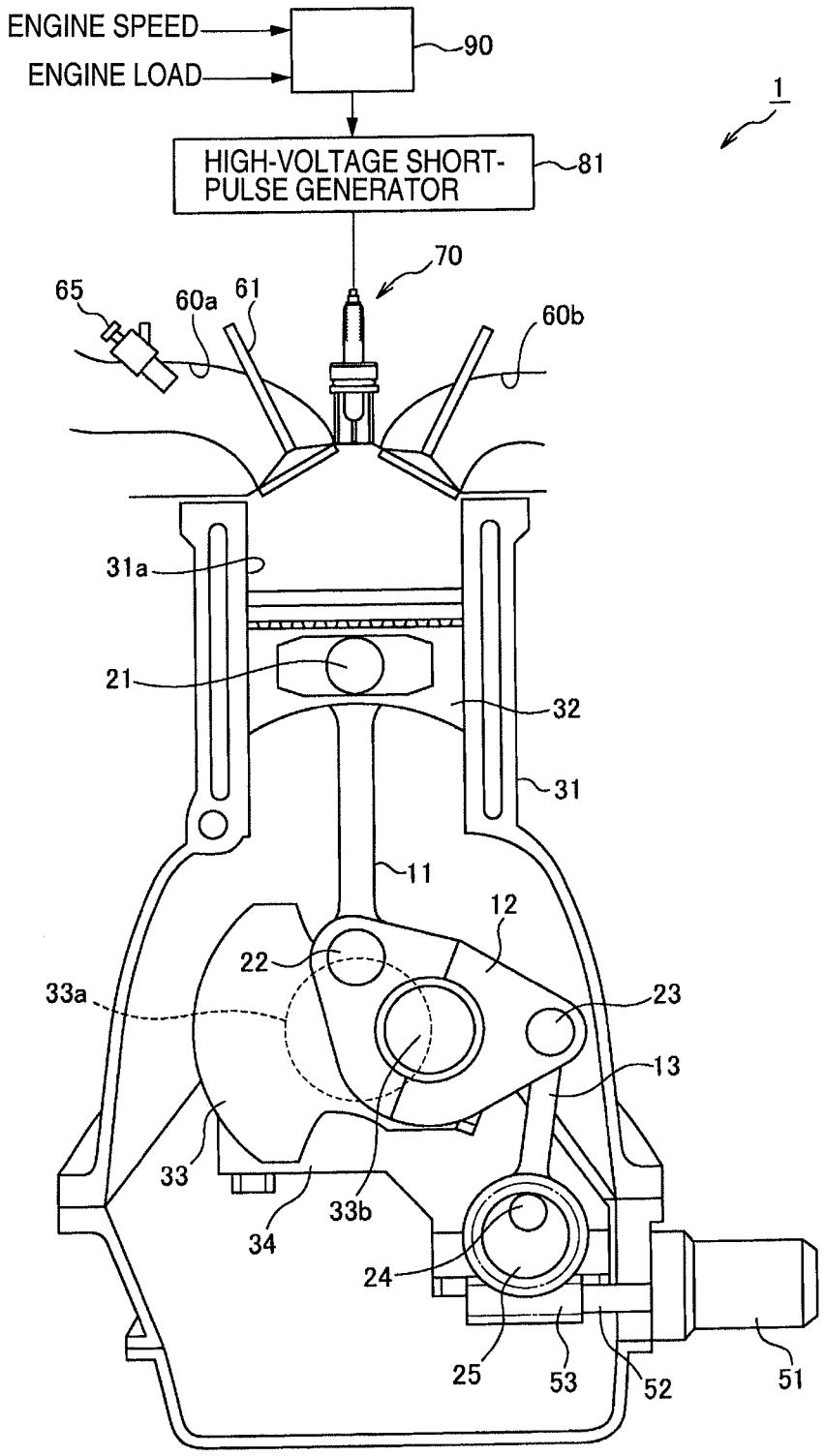
FIG. 23 is a simplified schematic cross-sectional view of a portion of a multi-link engine that contains an electric discharge device in accordance with a sixth embodiment.

Referring now to FIG. 23, an engine control apparatus in accordance with a sixth embodiment will now be explained. Basically, in this sixth embodiment, engine control apparatus of the first embodiment is replaced in FIG. 1 with a modified structure as discussed below. In view of the similarity between the first and sixth embodiments, the parts of the fifth embodiment that are identical to the parts of the first embodiment will be given the same reference numerals as the parts of the first embodiment. Moreover, the descriptions of the parts of the sixth embodiment that are identical to the parts of the first embodiment can be omitted for the sake of brevity.

FIG. 23 is a simplified schematic cross-sectional view of a portion of a multi-link engine that contains an electric discharge device in accordance with a sixth embodiment. In the present embodiment, the non-equilibrium plasma discharge device 70 is connected to a high-voltage short-pulse generator 81, instead of the high-voltage high-frequency generator 80 of the first-fifth embodiments. Additionally, the non-equilibrium plasma discharge device 70 is different than in the previously described embodiments regarding some details. These differences will now be explained with reference to FIGS. 24A and 24B. In this embodiment, the high-voltage short-pulse generator 81 constitutes a voltage application device.

Figure 24A:
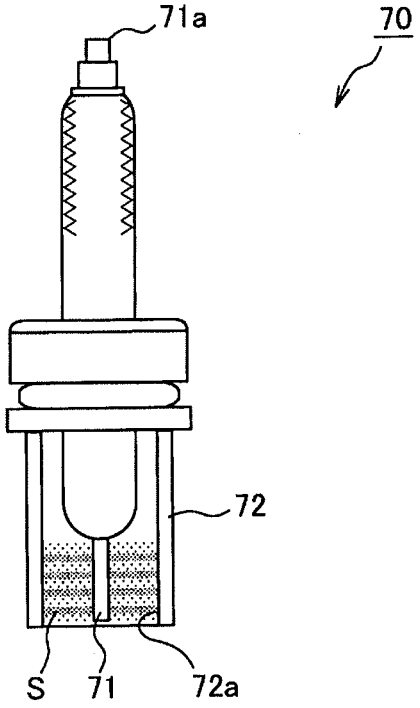
FIG. 24A is a partial cross-sectional view of the electric discharge device of the engine shown in FIG. 23.
Figure 24B:
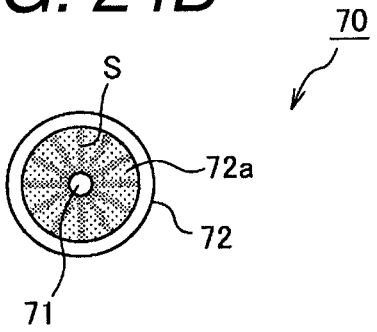
FIG. 24B is a cross-sectional view of the electric discharge device illustrated in FIG. 24A, taken along section line 24B-24B of FIG. 24A.

FIGS. 24A and 24B contain enlarged views of the non-equilibrium plasma discharge device 70. FIG. 24A is a partial cross-sectional view of the electric discharge device of the engine shown in FIG. 23. FIG. 24B is a cross-sectional view of the electric discharge device illustrated in FIG. 24A, taken along section line 24B-24B of FIG. 24A.

In this embodiment, a short pulse voltage is applied across the electrodes of the non-equilibrium plasma discharge device 70 and the voltage is shut off before an arc discharge occurs, thereby producing radicals between the electrodes. The central electrode 71 is connected to the high-voltage short-pulse generator 81 via the terminal 71*a*. A voltage value, pulse width, pulse count, and application duration of the voltage applied to the central electrode 71 by the high-voltage short-pulse generator 81 is controlled in accordance with the operating state of the engine.

When a short pulse voltage is applied from the high-voltage short-pulse generator 81 to the central electrode 71 and the voltage is shut off before an arc discharge occurs, streamers S develop between the central electrode 71 and the tubular electrode 72 as shown in FIG. 24A. A plurality of streamers S is generated in the vertical direction as shown in FIG. 24A. FIG. 24A illustrates a state in which four streamers have occurred on each of the right and left sides of the central electrode 71. As shown in FIG. 24B, the streamers extend in a radial fashion from the central electrode 71. FIG. 24B illustrates a state in which twelve streamers are generated in a radial fashion around the central electrode 71. The non-equilibrium plasma discharge device 70 can generate a large amount of radicals in the discharge chamber 72*a* by forming a plurality of streamers S. It is also possible for multipoint simultaneous ignition, i.e., a volumetric ignition (hereinafter referred to as "volume ignition"), to occur within the discharge chamber.

Figure 25:
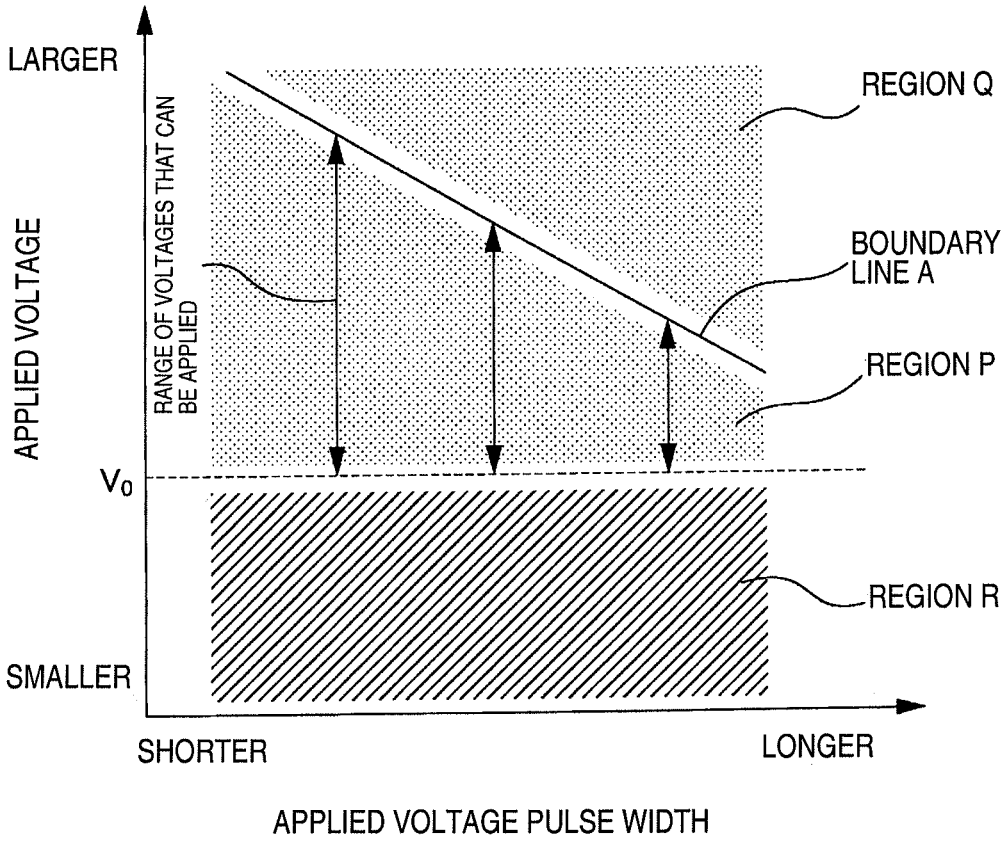
FIG. 25 is a graph showing the relationship between an applied voltage and an applied voltage pulse width of the electric discharge device.

The conditions under which a plurality of streamers S are formed in the non-equilibrium plasma discharge device 70 will now be explained. FIG. 25 is a graph showing the relationship between an applied voltage and an applied voltage pulse width of the electric discharge device. The pulse width of the applied voltage is indicated on the horizontal axis, and the applied voltage is indicated on the vertical axis.

As shown in FIG. 25, if the voltage applied to the non-equilibrium plasma discharge device 70 is too high and exceeds a boundary line A, then the discharge energy will become too large and the discharge mode will shift from a non-equilibrium plasma discharge region P to a thermal plasma discharge region Q. If the discharge mode of the non-equilibrium plasma discharge device 70 becomes a thermal plasma discharge, then a large current will flow through the portions where a short circuit occurs and the voltage will drop. As a result, a large amount of electric power will be consumed. Conversely, if the voltage applied between the central electrode 71 and the tubular electrode 72 of the non-equilibrium plasma discharge device 70 falls below a lower limit voltage $V_0$ and enters a region R, then the number of streamers S produced will be small or a dark current state will occur in which streamers are not formed at all.

Thus, in order for the non-equilibrium plasma discharge device 70 to execute a non-equilibrium plasma discharge and form a plurality of streamers S, it is necessary to a apply a high voltage with a short pulse width (e.g., several tens to several hundreds of nanoseconds), i.e., a voltage lying within the region P, to the non-equilibrium plasma discharge device 70. In particular, setting the pulse width to a shorter value makes the non-equilibrium plasma discharge easier to control because a wider range of voltages can be applied while remaining within the region P.

The location of the boundary line A between non-equilibrium plasma discharge and thermal plasma discharge and the location of the lower limit voltage $V_0$ both change depending on a relative density of the gases inside the combustion chamber. The larger the relative density is, the more the boundary line A and the lower limit voltage $V_0$ shift toward a larger applied voltage.

Figure 26A:
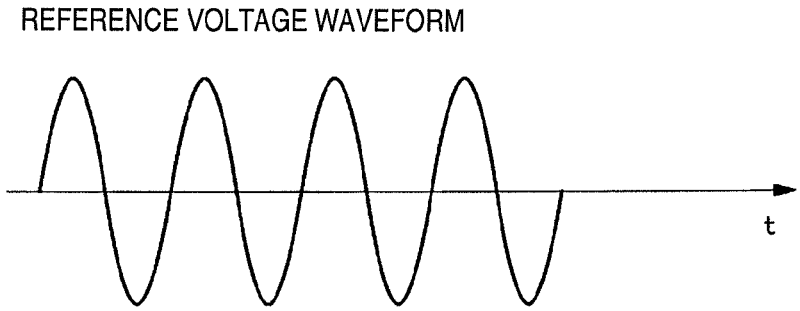
FIG. 26A is a diagram showing a waveform of an alternating current as a sine curve applied to the electric discharge device.
Figure 26B:
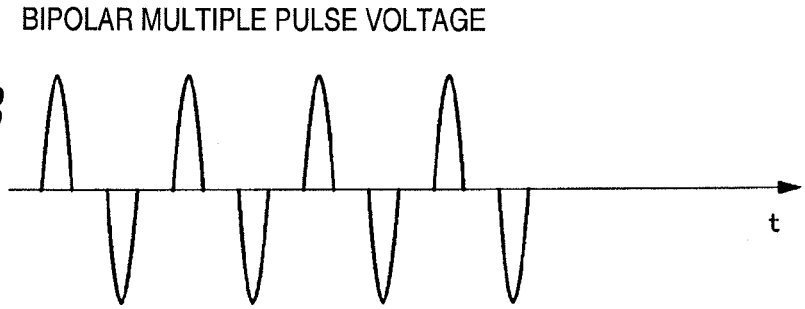
FIG. 26B is a diagram showing a waveform of an alternating current as a bipolar multiple pulse applied to the electric discharge device.

In this way, the same effects as the first embodiment can be obtained when a short pulse voltage is applied to the non-equilibrium plasma discharge device. For example, although an alternating current corresponding to the operating state of the engine is applied to the non-equilibrium plasma discharge device 70, the waveform of the alternating current is not limited to a sine curve (FIG. 26A). A bipolar multiple pulse power source may also be used, such as is shown in FIG. 26B.

Also in the above descriptions, a multi-link mechanism was exemplified as the variable compression ratio mechanism, but other possible examples include, e.g., a mechanism in which a hydraulic device is incorporated into the piston as such to adjust the height of the top surface of the piston, a mechanism in which the distance between the cylinder head and the cylinder block can be adjusted, and a mechanism in which the piston height can be adjusted by offsetting the center of the crankshaft.

Furthermore, the mechanism for adjusting the valve timing of the intake valve can also be, e.g., an oscillating cam which uses a link (Japanese Laid-Open Patent Application No. 2000-213314), a mechanism in which the cam is twisted in the manner of a vane-type variable valve timing system (Japanese Laid-Open Patent Application No. 9-60508), a system in which a switch is made between two types of cams having different timings in the manner of a direct variable valve timing system (Japanese Laid-Open Patent Application No. 4-17706), or the like.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. An engine control apparatus comprising:

an electric discharge device including a first electrode with a dielectric material covering the first electrode and a second electrode arranged opposite the first electrode on a periphery of the dielectric material to produce radicals within a combustion chamber of an internal combustion engine by a non-equilibrium plasma discharge that is generated between the first and second electrodes before autoignition of the air-fuel mixture occurs, the first electrode including a first voltage receiving end and a second engine attachment end with a long thin conductive material that discharges non-equilibrium plasma by a barrier discharge;

a voltage application device operatively coupled to the first voltage receiving end of the first electrode for applying a voltage between the first and second electrodes, such that the non-equilibrium plasma generates the radicals within the combustion chamber before an air-fuel mixture in the combustion chamber undergoes autoignition;

a fuel supplying device arranged to form an air-fuel mixture inside the combustion chamber; and a control unit operatively coupled to the voltage application device to vary a discharge start timing of the non-equilibrium plasma discharge in accordance with a mechanical load of the internal combustion engine such that the control unit sets the discharge start timing of the non-equilibrium plasma discharge to occur during an intake stroke of the combustion chamber in which the radicals are generated when the mechanical load of the internal combustion engine is in a low load range, and the discharge start timing of the non-equilibrium plasma discharge being set to occur during the intake stroke of the combustion chamber in which the radicals are generated when the mechanical load of the internal combustion engine is at the lowest engine load, the control unit sets the discharge start timing of the non-equilibrium plasma discharge to be increasingly retarded as the mechanical load of the internal combustion engine increases, and the control unit sets the discharge start timing of the non-equilibrium plasma discharge to occur during a compression stroke of the combustion chamber in which the radicals are generated when the mechanical load of the internal combustion engine is in a high load range, the control unit selectively setting a discharge ending timing of the non-equilibrium plasma discharge to occur after an intake valve of the combustion chamber in which the radicals are generated has opened and before the intake valve has closed during a single combustion cycle.

2. engine control apparatus as recited in claim 1, wherein the second electrode includes a tubular electrode surrounding at least a portion of the first electrode.

3. The engine control apparatus as recited in claim 2, further comprising a cylinder head having the second electrode attached thereto, with the first electrode including a linear central electrode.

4. The engine control apparatus as recited in claim 1, wherein the first electrode includes a linear central electrode; and the second electrode is disposed as at least part of one of a wall surface of a combustion chamber and a top surface of a piston.

5. The engine control apparatus as recited in claim 1, wherein the control unit selectively sets the discharge start timing of the non-equilibrium plasma discharge to be increasingly advanced as the mechanical load of the internal combustion engine becomes lower.

6. The engine control apparatus as recited in claim 1, wherein the control unit selectively sets the discharge start timing of the non-equilibrium plasma discharge to occur after an intake valve of the combustion chamber in which the radicals are generated has opened.

7. The engine control apparatus as recited in claim 1, wherein the control unit selectively sets a discharge energy of the non-equilibrium plasma discharge such that the discharge energy increases as the mechanical load of the internal combustion engine becomes lower when the mechanical load of the internal combustion engine is in a low load range.

8. The engine control apparatus as recited in claim 7, wherein the control unit increases the discharge energy of non-equilibrium plasma discharge by at least one method selected from increasing a voltage value of an AC voltage applied between the first and second electrodes, increasing a frequency of the AC voltage applied between the first and second electrodes, and increasing an application duration of the AC voltage applied between the first and second electrodes.

* * * * *